US011625972B2

(12) United States Patent
Tang

(10) Patent No.: US 11,625,972 B2
(45) Date of Patent: Apr. 11, 2023

(54) AUDIO SHARING DURING PRIVATE LISTENING AT AN ELECTRONIC GAMING MACHINE

(71) Applicant: IGT, Las Vegas, NV (US)

(72) Inventor: Yue Hang Tang, New Brunswick (CA)

(73) Assignee: IGT, Las Vegas, NV (US)

( * ) Notice: Subject to any disclaimer, the term of this patent is extended or adjusted under 35 U.S.C. 154(b) by 76 days.

(21) Appl. No.: 17/220,121

(22) Filed: Apr. 1, 2021

(65) Prior Publication Data

US 2021/0319646 A1 Oct. 14, 2021

Related U.S. Application Data

(60) Provisional application No. 63/008,402, filed on Apr. 10, 2020.

(51) Int. Cl.
*G07F 17/32* (2006.01)

(52) U.S. Cl.
CPC ..... *G07F 17/3204* (2013.01); *G07F 17/3223* (2013.01)

(58) Field of Classification Search
CPC ..... G07F 17/3204; G07F 17/3223
See application file for complete search history.

(56) References Cited

U.S. PATENT DOCUMENTS

| | | | | |
|---|---|---|---|---|
| 8,147,334 | B2 | 4/2012 | Gatto et al. | |
| 8,764,566 | B2 | 7/2014 | Miltenberger et al. | |
| 10,702,772 | B2 | 7/2020 | Archmueler et al. | |
| 2007/0068367 | A1* | 3/2007 | Schmidt | A63F 13/10 84/600 |
| 2010/0317437 | A1* | 12/2010 | Berry | G07F 17/3202 463/43 |
| 2013/0231185 | A1* | 9/2013 | Steil | A63F 13/2145 463/35 |
| 2017/0289202 | A1* | 10/2017 | Krasadakis | H04L 67/06 |
| 2017/0294072 | A1* | 10/2017 | Achmüller | G07F 17/3204 |

* cited by examiner

*Primary Examiner* — Werner G Garner
(74) *Attorney, Agent, or Firm* — Sheridan Ross P.C.

(57) ABSTRACT

The present disclosure relates generally to gaming machines, systems, and methods. As an example, a method is disclosed that includes receiving an invitation that provides a description of audio content to be shared, providing a query to a user of an electronic gaming machine requesting a confirmation to play the audio content to be shared, receiving a positive response to the query, sending a command to a different electronic gaming machine to transmit the audio content to be shared, receiving the audio content to be shared from the different electronic gaming machine, identifying a subset of a plurality of speakers from a speaker array to activate based on a determined position of the user relative to the speaker array, and causing the identified subset of the plurality of speakers to output the audio content to be shared as part of a directed sound beam.

20 Claims, 12 Drawing Sheets

AUDIO SHARING DURING PRIVATE LISTENING AT AN ELECTRONIC GAMING MACHINE

CROSS REFERENCE TO RELATED APPLICATION

The present application claims priority to U.S. Provisional Application No. 63/008,402, filed Apr. 10, 2020, the entire disclosure of which is hereby incorporated by reference.

BACKGROUND

The present disclosure is generally directed to electronic gaming machines and, in particular, audio features associated with electronic gaming machines.

Certain types of gaming machines include one or more primary wagering games and some may include one or more secondary games, such as bonus games. Many gaming machines enable gameplay to begin upon receiving a wager or appropriate credit from a user or player of the gaming machine. The amount of the wager may determine how much is eventually available to the user or player as an award, but the award may also be based on a randomly determined outcome of the gameplay events. Many gaming machines are also equipped with lights, buzzers, speakers, and other output devices to further enhance the player's experience with the gaming machine.

BRIEF SUMMARY

In certain embodiments, the present disclosure relates to an electronic gaming machine, a system, and a method. In some embodiments, an electronic gaming machine is provided, comprising: a housing; a network interface; a speaker array connected with the housing and including a plurality of speakers positioned to output directed sound beams at different angles relative to a front side of the housing; a processor coupled with the speaker array and coupled with the network interface; and a memory device coupled with the processor. The memory device may also include instructions that, when executed, cause the processor to: receive an invitation from a different electronic gaming machine that provides a description of audio content to be shared; provide a query to a user of the electronic gaming machine requesting a confirmation to play the audio content to be shared; receive, from the user, a positive response to the query; send, via the network interface, a command to the different electronic gaming machine to transmit the audio content to be shared; receive the audio content to be shared from the different electronic gaming machine; identify a subset of the plurality of speakers to activate based on a determined position of the user relative to the speaker array; and cause the identified subset of the plurality of speakers to output the audio content to be shared as part of a directed sound beam.

In some embodiments, an electronic gaming machine is provided, comprising: a network interface; a processor coupled with the network interface; and a memory device coupled with the processor. The memory device may also include instructions that, when executed, cause the processor to: receive a command from a different electronic gaming machine indicating a desire to receive gameplay audio associated with gameplay between a user and the electronic gaming machine; provide a query to the user of the electronic gaming machine requesting a confirmation to share the gameplay audio with the different electronic gaming machine; receive, from the user, a positive response to the query; filter out sounds other than winning event sounds from the gameplay audio; and transmit, via the network interface, the filtered gameplay audio to the different electronic gaming machine.

In some embodiments, a method of operating an electronic gaming machine is provided, comprising: receiving, at a processor, an invitation from a different electronic gaming machine that provides a description of audio content to be shared; providing, with the processor, a query to a user of the electronic gaming machine requesting a confirmation to play the audio content to be shared; receiving, at the processor and from the user, a positive response to the query; sending, with the processor, a command to the different electronic gaming machine to transmit the audio content to be shared; receiving, at the processor, the audio content to be shared from the different electronic gaming machine; identifying, with the processor, a subset of a plurality of speakers from a speaker array to activate based on a determined position of the user relative to the speaker array; and causing, with the processor, the identified subset of the plurality of speakers to output the audio content to be shared as part of a directed sound beam.

Additional features and advantages are described herein and will be apparent from the following Description and the figures.

DETAILED DESCRIPTION

Figure 1:
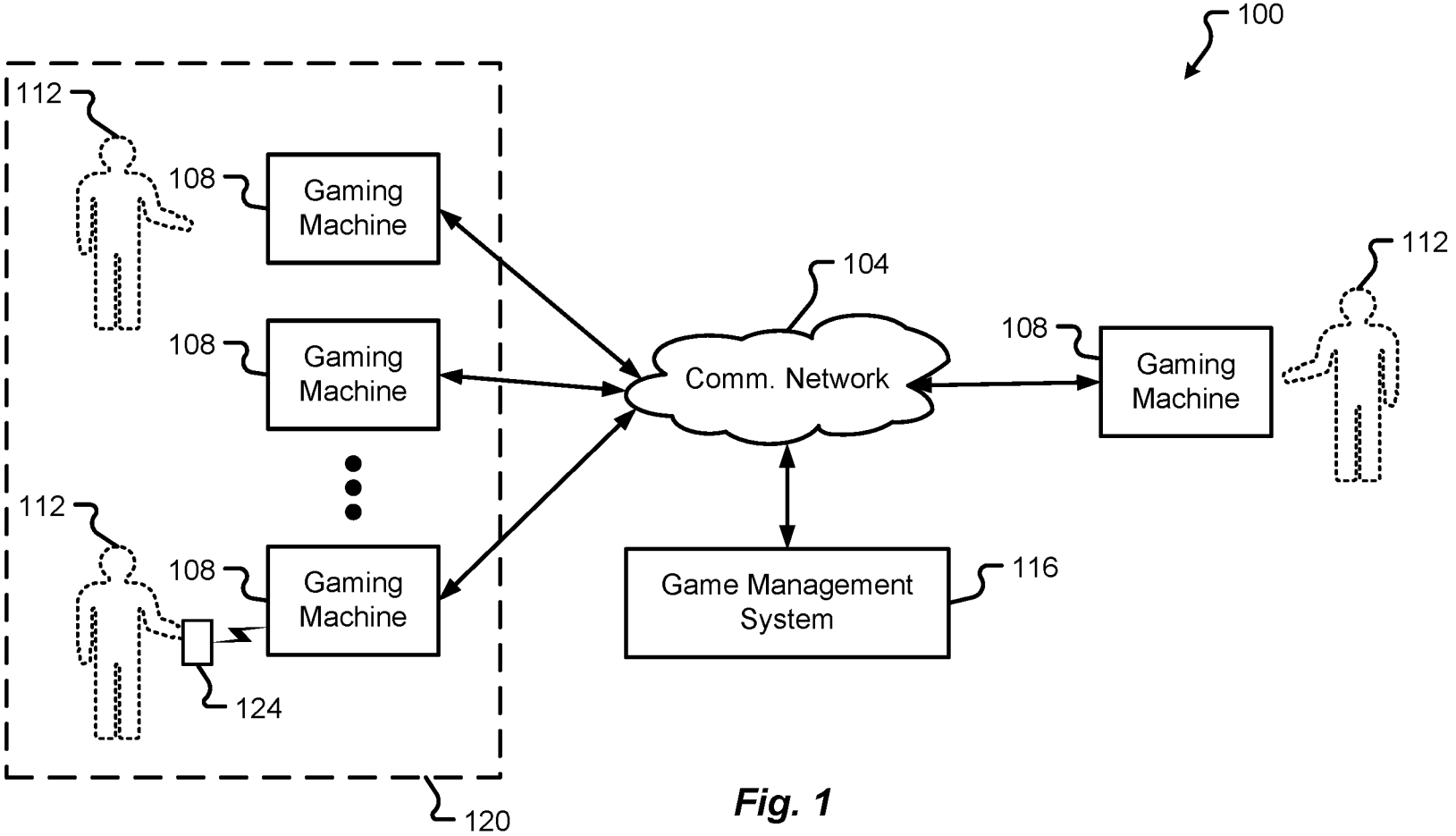
FIG. 1 is a block diagram of a gaming system that enables audio sharing between gaming machines in accordance with embodiments of the present disclosure.

Embodiments of the present disclosure will be described in connection with an Electronic Gaming Machine (EGM) that is configured to interact with and share audio content with another gaming machine. While particular embodiments will be described in connection with one gaming machine sharing audio content with another gaming machine, it should be appreciated that embodiments are not so limited. More specifically, it is contemplated that a single gaming machine may share audio content with a plurality of other gaming machines. Conversely, embodiments of the present disclosure contemplate that a single gaming machine may receive shared audio content from a plurality of other gaming machines and may play the shared audio content for a user of the gaming machine via one or multiple directed sound beams. It should be appreciated that the present disclosure contemplates sharing audio content between one, two, three, four or more gaming machines. The present disclosure also contemplates the use of some gaming machines playing shared audio content with a plurality of speakers that may or may not produce a directed sound beam. The present disclosure also contemplates the use of some gaming machines playing shared audio content with one or more speakers that may or may not produce a directed sound beam.

While particular embodiments will be described in connection with the game management system having a particular architecture, it should be appreciated that certain behaviors or features of a gaming machine may be carried out with other architectures. For instance, aspects of the present disclosure contemplate that gaming machines may share audio content using a point-to-point communication protocol, a distributed communication protocol, a broadcast communication protocol, or any other communication protocol that enables audio content to be shared between two or more gaming machines.

Moreover, the examples of game management systems (whether centralized or distributed) depicted and described herein should not be construed as limiting. For instance, one example of the game management system may correspond to a casino game management system that is used to track player activity with respect to a particular game natively offered at the gaming machine (e.g., video poker, slots, keno, etc.). The casino game management system, in some embodiments, may correspond to a traditional slot Player Tracking System (PTS) that allows a player to play one or more casino games at the EGM. Another non-limiting example of the game management system may correspond to a sports wagering system. In this particular situation, a player may be allowed to play a traditional casino game at the gaming machine while also betting and tracking bets placed on sports events (or other wagerable events). Various game management systems may have their own player accounts, data formatting requirements, protocols, etc.

Embodiments of the present disclosure contemplate enabling one or more gaming machines with the ability to provide players thereof with an option for delivering audio content from one gaming machine to another gaming machine in a private manner such as by using headphones or directional audio speakers. If a player wants to play with his/her friend on a different gaming machine or with a group of players, the player may be enabled to share audio content (e.g., sound effects, music, excitement noise, gameplay noise, gameplay audio, etc.) via their gaming machine. In some embodiments, players may be enabled to designate or define a sharing relationship between their gaming machine and another gaming machine and a sharing authentication process may be performed prior to sharing audio content between the gaming machines. As an example, an on-screen notification may be provided to one or both players of different gaming machines that help the players define their sharing preferences and that further help the players differentiate if certain sounds correspond to gameplay audio of their machine corresponding to their gaming experience versus shared audio content that has originated from a different gaming machine. In other words, one or more displays may be provided to players to help differentiate whether sounds are originating from their gaming machine or from another gaming machine via shared audio content.

For example, if a sharing option is enabled between two gaming machines, a first player at a first gaming machine may be allowed to hear both winning sounds from the first gaming machine and from a second gaming machine being played by a second player (that is different from the first player). Likewise, in some embodiments, the second player sitting at the second gaming machine may be allowed to hear winning sounds from the first gaming machine and the second gaming machine. If both players are utilizing audio devices that maintain the privacy of audio content (e.g., players are using headphones and/or directed sound beams), then only the first and second players will hear the audio content being produced by the first and second gaming machines, whereas others passing by the gaming machines will not hear audio content of either gaming machine.

These and other aspects will now be described in further details with reference to FIGS. 1-11.

Gaming System

With reference initially to FIG. 1, details of an illustrative gaming system 100 will be described in accordance with at least some embodiments of the present disclosure. The components of the system 100, while depicted as having particular instructions and devices, are not necessarily limited to the examples depicted herein. Rather, a system according to embodiments of the present disclosure may include one, some, or all of the components depicted in the system 100 and does not necessarily have to include all of the components in a single device.

The gaming system 100 is shown to include one or more communication networks 104 that interconnect and facilitate machine-to-machine communications between one or multiple gaming machines 108 and a game management system 116. It should be appreciated that a communication network 104 may correspond to one or many communication networks or cellular networks without departing from the scope of the present disclosure. In some embodiments, the gaming machines 108 and game management system 116 may be configured to communicate using various nodes or components of a communication network 104.

The communication network 104 may include wired and/or wireless communication technologies. The Internet is an example of the communication network 104 that constitutes an Internet Protocol (IP) network consisting of many computers, computing networks, and other communication devices located all over the world, which are connected through many telephone systems and other means. Other examples of the communication network 104 include, without limitation, a standard Plain Old Telephone System (POTS), an Integrated Services Digital Network (ISDN), the Public Switched Telephone Network (PSTN), a Local Area Network (LAN), a Wide Area Network (WAN), a cellular network, and any other type of packet-switched or circuit-switched network known in the art. In addition, it can be appreciated that the communication network 104 need not be limited to any one network type, and instead may be comprised of a number of different networks and/or network types. Moreover, the communication network 104 may comprise a number of different communication media such as coaxial cable, copper cable/wire, fiber-optic cable, antennas for transmitting/receiving wireless messages, and combinations thereof.

In some embodiments, the gaming machines 108 may be distributed throughout a single property or premises (e.g., a single casino floor) or the gaming machines 108 may be distributed among a plurality of different properties. In the depicted embodiment, three or more gaming machines 108 are depicted as being co-located in a common location 120 (e.g., a casino) whereas another gaming machine 108 is depicted as being positioned in a location different from the common location 120. It should be appreciated that more than one gaming machine 108 may be separated by other gaming machines 108 by one or multiple different communication networks 104. It should also be appreciated that two gaming machines 108 sharing audio content may be in the common location 120 or may be physically separated from one another (e.g., in different casinos or different physical premises). Embodiments of the present disclosure contemplate the ability to enable gaming machines 108 to share audio content when they are immediately adjacent to one another or when they are separated by large distances (e.g., hundreds of miles). Although not depicted, two gaming machines 108 located in the common location 120 may be connected by a first communication network 104 (e.g., a LAN or direct wire connections known to be provided in a bank of gaming machines 108) whereas gaming machines 108 located in different locations may be connected by a WAN or a number of different communication networks 104.

Some or all of the gaming machines 108 in the common location 120 may be connected with a cellular access point via a wireless connection. As some non-limiting examples, a cellular access point made available to a gaming machine 108 may include a cellular base station, a Wi-Fi access point, a modem, a wireless router, or the like. The communication network 104 may utilize any type of multiplexing scheme to manage the various communications from multiple gaming machines 108. Examples of such multiplexing schemes include, without limitation, Frequency Division Multiple Access (FDMA), Time Division Multiple Access (TDMA), Code Division Multiple Access (CMDA), and/or Space Division Multiple Access (SDMA).

The various gaming machines 108 may utilize the same or different types of communication protocols to connect with the communication network 104. It should also be appreciated that the gaming machines 108 may or may not present the same type of game or wagering interface to a user 112. For instance, a first gaming machine 108 may correspond to a gaming machine that presents a slot game to the user 112, the second gaming machine 108 may correspond to a sports betting terminal, and other gaming machines 108 may present lottery games or other types of games or a plurality of different games for selection and eventual play by a user 112.

A gaming machine 108 may correspond to a type of device that enables user 112 interaction in connection with making wagers, communicating, watching live competitive contests, and/or playing games of chance. For instance, the gaming machines 108 may correspond to a type of device that enables a first user 112 to interact with a second user 112 at respective gaming machines 108. In other embodiments, each user 112 may be enabled to play a game individually at a gaming machine 108. Interactions between users 112 of different gaming machines 108 may be facilitated by audio content sharing techniques which will be described in further detail herein.

As will be discussed in further detail herein, a user 112 may be allowed to carry a mobile device 124 and the mobile device 124 may also be used to interact with the game management system 116. A mobile device 124 may be utilized by the user 112 to create a player account, manage player profile information at the game management system 116, and/or connect with a gaming machine 108. It should also be appreciated that a mobile device 124 may be provided with functionality similar or identical to a gaming machine 108. In some embodiments, a mobile device 124 may be considered a particular type of gaming machine 108 in that a user 112 may utilize the mobile device 124 and resources thereof to play games of chance or other types of wagering games. Embodiments of the present disclosure contemplate that a user 112 of one gaming machine 108 may share audio content from their gaming machine with another user's 112 mobile device 124. In such a situation, the user's 112 mobile device 124 that receives shared audio content from the other gaming machine 108 may also be referred to as a mobile device 124. In other words, audio content may be shared between a gaming machine 108 and a mobile device 124 or between two mobile devices 124 without departing from the scope of the present disclosure.

In some embodiments, a user 112 may login to the game management system 116 by presenting the mobile device 124 to a gaming machine 108, which causes components of the gaming machine 108 to initiate a login process with the game management system 116 on behalf of the user 112.

As mentioned above, the game management system 116 may correspond to a system used by a casino operator to manage slot games, video poker games, bingo games, keno games, or the like that are played on one or more of the gaming machines 108 and/or mobile devices 124. In some embodiments, the game management system 116 may correspond to a system used by the casino operator to manage sports wagers placed by users 112 either at a sports desk or at a gaming machine 108. As another example, the game management system 116 may be used by to manage and execute a lottery game or multiple lottery games. As will be discussed in further detail herein, the gaming management system 116 may be configured to facilitate or coordinate audio sharing between gaming machines 108 and/or mobile devices 124, although involvement of the game management system 116 is not required. Rather, it may also be possible for gaming machines 108 to utilize a point-to-point sharing protocol in which one gaming machine 108 directly communicates with another gaming machine 108 and the involvement of the game management system 116 is either not required at all or only required to set up the necessary communication channels for sharing audio content.

Gaming Machine

Figure 2:
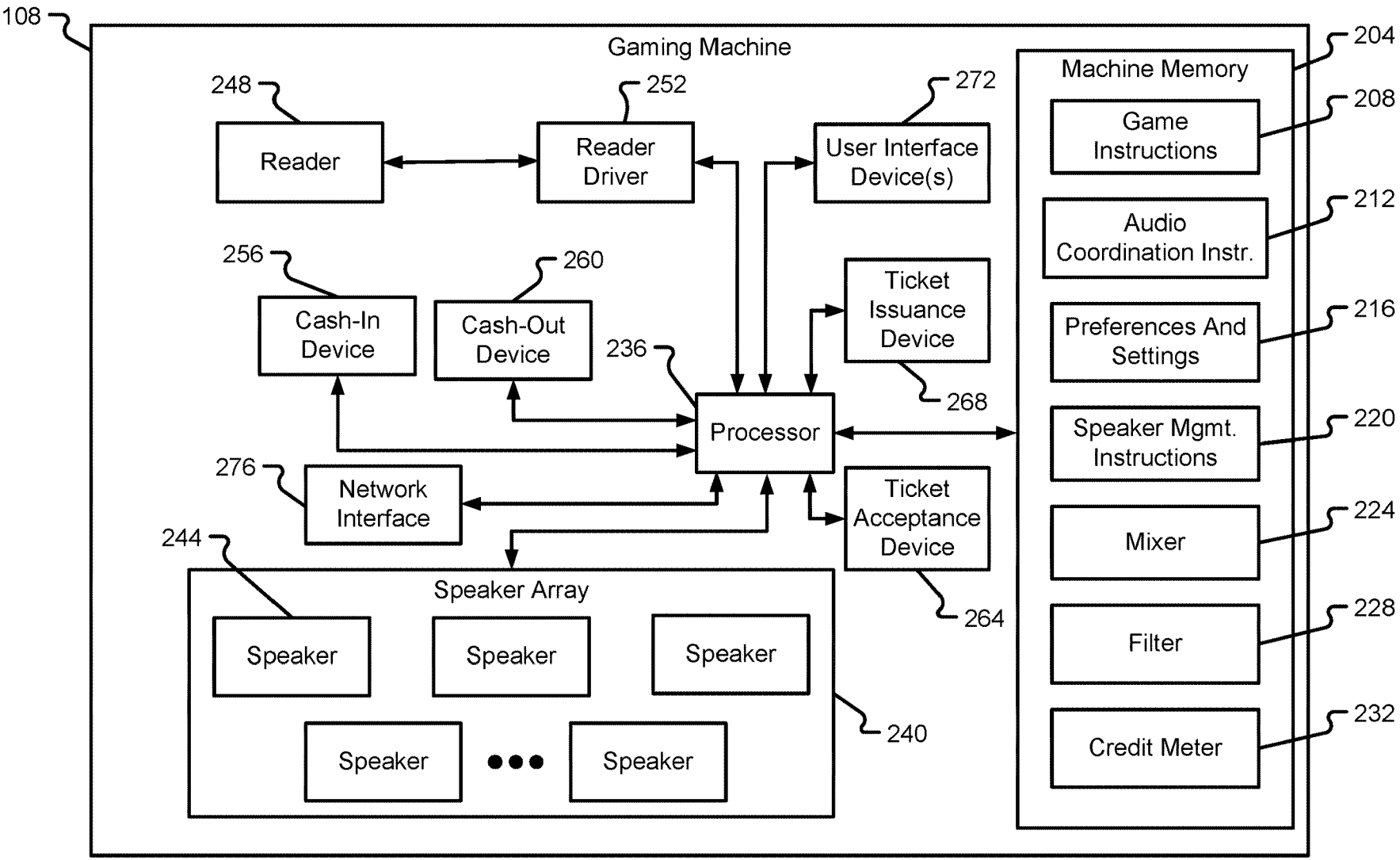
FIG. 2 is a block diagram depicting details of a gaming machine in accordance with embodiments of the present disclosure.

With reference now to FIG. 2, additional details of a gaming machine 108 will be described in accordance with at least some embodiments of the present disclosure. While depicted as a gaming machine 108, it should be appreciated that some or all of the components of a single gaming machine 108 may be distributed across multiple gaming machines 108 (of the same or different type) without departing from the scope of the present disclosure. It should also be appreciated that one or more features of a gaming machine 108 may be provided in a user's 112 mobile device 124 without departing from the scope of the present disclosure.

The gaming machine 108 is shown to include machine memory 204, a processor 236, a reader 248, a reader driver 252, a cash-in device 256, a cash-out device 260, a ticket acceptance device 264, a ticket issuance device 268, one or more user interface devices 272, and a speaker array 240.

The processor 236 may include one or multiple computer processing devices. In some embodiments, the processor 236 may include a microprocessor, a CPU, a microcontroller, or the like. The processor 236 may also be configured to execute one or more instructions stored in machine memory 204.

The machine memory 204 may include one or multiple computer memory devices that are volatile or non-volatile. The machine memory 204 may be configured to store instructions that enable user 112 interaction with the gaming machine 108, that enable the gaming machine 108 to interact with a game of chance, that enable the gaming machine 108 to interact with a game management system 116, that enable the user 112 to interact with the game management system 116, that enable a gaming machine 108 to transmit audio content to another gaming machine 108, accept audio content from another gaming machine 108, mix audio content received from another gaming machine 108 with gameplay audio being produced by the user's 112 interactions with the gaming machine 108, and the like. The machine memory 204 may be provided as a computer-readable medium that stores the instructions and various other data structures or code elements. Examples of instructions that may be stored in the machine memory 204 include game instructions 208, audio coordination instructions 212, speaker management instructions 220, a mixer 224, a filter 228, and the like. The machine memory 204 is also shown to store various types of data or data sets describing the gaming machine 108, details of a gaming session being conducted by a user 112 at the gaming machine 108, and/or details of a user 112 of the gaming machine 108. As some non-limiting examples, the machine memory 204 may be used to store preferences and settings 216 and a credit meter 232.

The game instructions 208, when executed by the processor 236, may enable the gaming machine 108 to facilitate one or more games of chance or skill and produce interactions between the user 112 and the game of chance or skill. In some embodiments, the game instructions 208 may include subroutines that present one or more graphics and/or audio content to the user 112 via a user interface device 272 and/or speaker array 240 in accordance with preferences and settings 216, subroutines that calculate whether a particular game wager has resulted in a win or loss during the game of chance or skill, subroutines for determining payouts for the user 112 in the event of a win, subroutines for determining whether a user 112 has enough available credits in the credit meter 232 to allow a particular bet or set of bets, and any other subroutine or set of instructions that facilitate gameplay at or in association with the gaming machine 108. In some embodiments, activities, outputs, or inputs of the game instructions may be stored or recorded as machine state information, which may also be stored in machine memory 204.

The audio coordination instructions 212, when executed by the processor 236, may enable the gaming machine 108 to share audio content with one or multiple other gaming machines 108. The audio coordination instructions 212 may be configured to provide gameplay audio representing events occurring at the gaming machine 108 to a user 112 of the gaming machine 108 via one or more speakers 244 of the speaker array 240. The audio coordination instructions 212 may also be configured to share audio content with other gaming machines 108 via a network interface 276. In some embodiments, the audio coordination instructions 212 may enable the gaming machine 108 to collect gameplay audio from the game instructions 208, prepare the gameplay audio for transmission to another gaming machine 108, and then send the gameplay audio to the other gaming machine 276 via the network interface 276 as shared audio content. The audio coordination instructions 212 may further be configured to receive shared audio content from another gaming machine 108 via the network interface 276 and prepare the shared audio content for presentation to a user 112 of the gaming machine 108 via the speaker array 240 and/or other user interface devices 272.

In some embodiments, the audio coordination instructions 212 may be configured to utilize or call upon speaker management instructions 220 to determine which speakers 244 from the speaker array 240 should be used to provide gameplay audio and/or shared audio content received from another gaming machine 108. The audio coordination instructions 212 may also leverage the speaker management instructions 220 and reference the preferences and settings 216 to determine an appropriate relative volume with which gameplay audio and shared audio content should be provided by the speaker array 240.

In some embodiments, the audio coordination instructions 212 may utilize the speaker management instructions 220 to determine how best to mix gameplay audio with shared audio content. Mixing decisions made by the combined efforts of the audio coordination instructions 212 and speaker management instructions 220 may be executed with a mixer 224. In some embodiments, the mixer 224 may be used to mix two or more different audio streams (e.g., one audio stream containing gameplay audio and other audio stream(s) containing shared audio content from one or more other gaming machines 108) into a single audio stream that is capable of being output by selected speakers 244 of the speaker array 240. It should also be appreciated that the output of the mixer 224 may be provided to headphones of a user 112, to a user's 112 mobile device 124, or to some other user interface device 272 that ultimately presents the output of the mixer 224 to the user 112. In some embodiments, headphones having two speakers 244 (e.g., for left ear and right ear) may be considered a speaker array 240 without departing from the scope of the present disclosure.

In addition to leveraging the mixer 224, the audio coordination instructions 212 and/or speaker management instructions 220 may be configured to utilize a filter 228 to filter shared audio content received from another gaming machine 108 prior to playing the shared audio content for the user 112 of the gaming machine 108. Similarly, the filter 228 may be used by the audio coordination instructions 212 to prepare gameplay audio for transmission to another gaming machine 108. Specifically, the audio coordination instructions 212 may be configured to filter out certain type of sounds, sound effects, noises, music, etc. that are included in gameplay audio, but are not desirable to include in shared audio content. As a non-limiting example, the audio coordination instructions 212 may be configured to filter out sounds or sound effects from gameplay audio that do not correspond to winning event sounds (e.g., sound effects or music associated with a winning event output by the game instructions 208). In this way, the audio coordination instructions 212 can prefilter gameplay audio prior to transmitting the gameplay audio as shared audio content to another gaming machine 108. This pre-filtering process may help minimize the amount of data placed onto the network interface 276 and eventually the communication network 104. Pre-filtering may help minimize network latency and delays between one gaming machine 108 registering a winning event and another gaming machine 108 producing an output of audio for that winning event in response to receiving shared audio content from the gaming machine 108 that registered the winning event. The filter 228 may also help the gaming machine 108 avoid or manage conflicts between playing two different sound effects at the same time, where one sound effect is originating from the local game instructions 208 whereas the other sound effect is originating from the other gaming machine 108 and has been received as shared audio content.

In some embodiments, the preferences and settings 216 may correspond to gameplay preferences or settings defined by the user 112 of the gaming machine 108. Because embodiments of the present disclosure also contemplate audio sharing between gaming machines 108, it should be appreciated that the preferences and settings 216 may also correspond to or include one or more preferences defined by a user 112 of another gaming machine 108 that is sharing audio content from their gaming machine 108 with the local gaming machine 108. The preferences and settings 216 of one or both users 112 may be defined during the audio sharing setup process and may be maintained until such time as the users 112 decide to stop sharing audio content with one another.

The credit meter 232 may correspond to a device or collection of devices that facilitates a tracking of wager activity or available wager credits at the gaming machine 108. Such credits may be made available for wagers or bets placed on a game managed by the game management system 116. In some embodiments, the credit meter 232 may be used to store or log information related to various user 112 activities and events that occur at the gaming machine 108. The types of information that may be maintained in the credit meter 232 include, without limitation, player information, available credit information, RTP information, wager amount information, and other types of information that may or may not need to be recorded for purposes of accounting for wagers placed at the gaming machine 108 and payouts made for a user 112 during a game of chance or skill played at the gaming machine 108. In some embodiments, the credit meter 232 may be configured to track coin-in activity, coin-out activity, coin-drop activity, jackpot paid activity, bonus paid activity, credits applied activity, external bonus payout activity, ticket/voucher in activity, ticket/voucher out activity, timing of events that occur at the gaming machine 108, and the like. Some or all of the data within the credit meter 232 may be reported to the game management system 116 via coordinated efforts of the processor 236 and network interface 276.

The network interface 276 may correspond to or include any type of device that enables the gaming machine 108 to connect with the communication network 104 or with another gaming machine 108. In some embodiments, the network interface 276 may include one or more communication ports, switches, routes, etc. that connect with a cable or the like. Alternatively or additionally, the network interface 276 may include an antenna and/or a driver for the antenna that enables the gaming machine 108 to wirelessly communicate with other machines.

The cash-in device 256 may include a bill acceptor, a coin acceptor, a chip acceptor or reader, or the like. In some embodiments, the cash-in device 256 may also include credit card reader hardware and/or software. The cash-out device 260 may operate and issue cash, coins, tokens, or chips based on an amount indicated within the credit meter 232. In some embodiments, the cash-out device 260 may include a coin tray or the like and counting hardware configured to count and distribute an appropriate amount of coins or tokens based on a user's 112 winnings or available credit within the credit meter 232.

The gaming machine 108 may also be provided with a ticket acceptance device 264 that is configured to accept or scan physically printed tickets/vouchers and extract appropriate information therefrom. In some embodiments, the ticket acceptance device 264 may include one or more machine vision devices (e.g., a camera, IR scanner, optical scanner, barcode scanner, etc.), a physical ticket acceptor, a shredder, etc. The ticket acceptance device 264 may be configured to accept physical tickets and/or electronic tickets without departing from the scope of the present disclosure. An electronic ticket/voucher may be accepted by scanning a one-dimensional barcode, two-dimensional barcode, or other type of barcode or quick response (QR) code displayed by a user's 112 mobile communication device 124, for example.

The ticket issuance device 268 may be configured to print or provide physical tickets/vouchers to users 112. In some embodiments, the ticket issuance device 268 may be configured to issue a ticket/voucher consistent with an amount of credit available to a user 112, possibly as indicated within the credit meter 232.

The user interface device(s) 272 may correspond to any type of mechanical or software-based input and/or output device. In some embodiments, the user interface device(s) 272 may be provided on a common panel or portion of the gaming machine 108 and may be used to initiate a predetermined function in response to being pressed by the user 112. In addition to the examples of user interface devices 272 described above, it should be appreciated that a user interface device 272 may alternatively or additionally take the form of one or more depressible buttons, a lever or "one armed bandit handle," etc. The user interface device(s) 272 may include components that present content to the user 112 in a visual fashion (e.g., displays, lights, screens, etc.). The user interface device(s) 272 may include components that present content to the user 112 in an audible fashion (e.g., buzzers, speakers 244, headphones, etc.). The user interface device(s) 272 may also include one or more combined user input/user output devices (e.g., a touch-sensitive display or a lighted button) without departing from the scope of the present disclosure.

The speaker array 240 may include one or many speakers 244 for producing audible sounds or outputs for the user 112. In some embodiments, the speakers 244 of the speaker array 240 may be coordinated or selectively activated by the speaker management instructions 220. In some embodiments, the speaker management instructions 220 may be configured to detect a position of a user 112 relative to the gaming machine 108 or relative to the speakers 244 of the speaker array 240 and then may select appropriate speakers from the speaker array 240 for outputting gameplay audio and/or shared audio content. In some embodiments, the speakers 244 of the speaker array 240 may be controlled in such a way that a directed sound beam is produced and delivered to the user 112 of the gaming machine 108. A directed sound beam, in some embodiments, may be produced by the speaker management instructions 220 employing one or more sound cards or drivers to activate selected speakers 244 in the speaker array 240. In some embodiments, the speaker management instructions 220 may be configured to utilize eye tracking and/or head tracking technologies to determine which of the speakers 244 to activate and which to deactivate in connection with producing a particular sound beam. Examples of such eye tracking and head tracking technologies are further described in U.S. patent application Ser. No. 15/707,639 filed on Sep. 18, 2018.

The reader 248 may be configured to read credentials of different types. For instance, the reader 248 may be configured to read the mobile device 124 or other credentials that operate with a defined protocol or utilize an expected data format. The format or form factor of a credential carried by the user 112 should not be limited to any particular type of format or form factor. Examples of suitable form factors that may be as a credential include, without limitation, magstripe cards, chip-based cards, contactless/wireless cards, key fobs, mobile devices 124, optically-readable cards, or the like. It should be appreciated that a user's 112 credential may be capable of being read by a reader 248 when brought within a predetermined distance of the reader 248 (e.g., if the reader 248 includes an antenna and is utilize a contactless communication protocol like Near Field Communications (NFC) or Bluetooth). Alternatively or additionally, a credential may be capable of being read by a reader 248 when inserted to a slot of a card reader 248 or swiped through a card reader 248. To the extent that the form factor of a credential can vary and is not limited, it should be appreciated that the reader 248 may be provided with any number of hardware and/or software components to enable interactions with a credential. More specifically, each a reader 248 may include one or multiple readers, each of which may be provided with appropriate hardware and/or software components to enable the reader 248 to extract/read data that is stored on a credential and/or mobile device 124.

Game Management System

Figure 3:
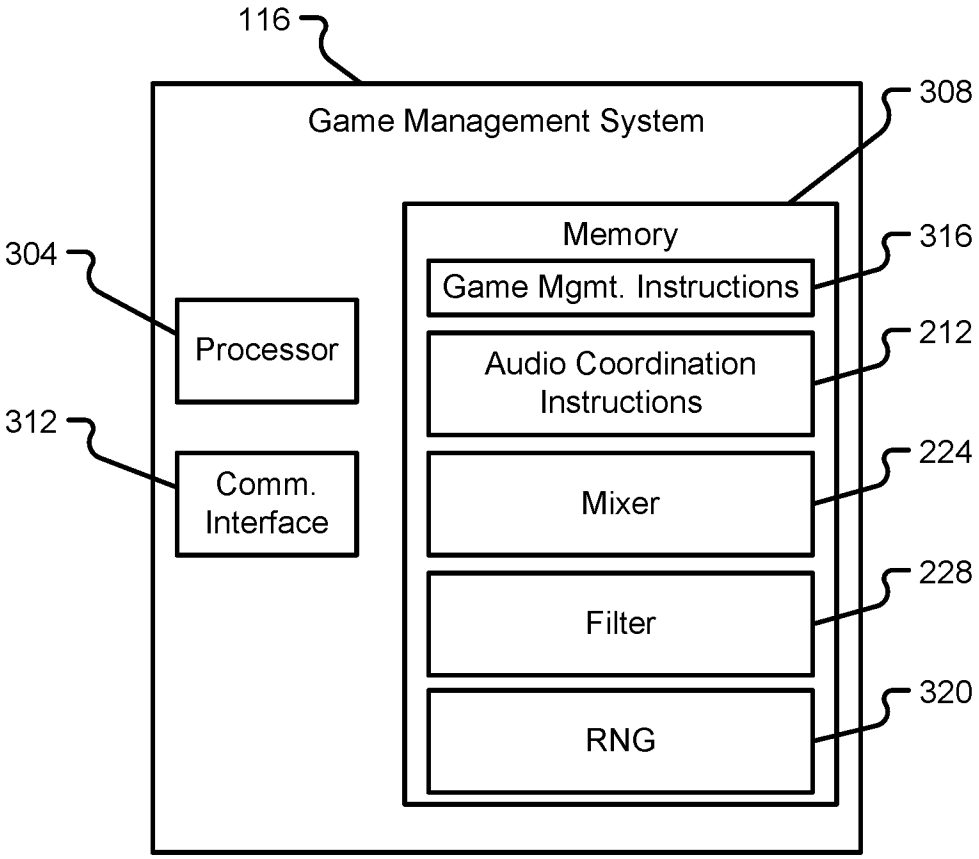
FIG. 3 is a block diagram depicting details of a game management system for coordinating the sharing of audio content between gaming machines in accordance with embodiments of the present disclosure.

With reference now to FIG. 3, additional details of a game management system 116 will be described in accordance with at least some embodiments of the present disclosure. The game management system 116 may include a distributed computing architecture (e.g., a plurality of servers). Some or all of the servers in the game management system 116 may be configured with similar components, instructions, code sets, or the like, which means that the game management system 116 may correspond to a distributed and highly-available system in which one or more servers act to backup other servers. Alternatively or additionally, the servers of the game management system 116 may be configured for parallel data processing capabilities.

Although details of a game management system 116 are shown in FIG. 3 as being provided in a single device, it should be appreciated that multiple devices (e.g., multiple servers) may be provided with similar or identical components. Alternatively, some components depicted in FIG. 3 may be provided in one server whereas other components may be provided in another server. For illustrative purposes, a game management system 116 may include a processor 304, memory 308, and a communication interface 312.

The processor 304 may be similar or identical to processor 204 and/or data processor 288. In some embodiments, the processor 304 may include one or multiple computer processing devices. In some embodiments, the processor 304 may include a microprocessor, a CPU, a microcontroller, or the like. The processor 304 may also be configured to execute one or more instructions stored in memory 308.

The communication interface 312 may enable the game management system 116 to connect with the communication network 104. The communication interface 312 may include one or more communication ports, switches, routes, etc. that connect with a cable or the like. Alternatively or additionally, the communication interface 312 may include an antenna and/or a driver for the antenna that enables the game management system 116 to wirelessly communicate with other machines.

The memory 308 may be similar or identical to other memory devices depicted and described herein. For instance, the memory 308 may be similar or identical to machine memory 204. The memory 308 may include one or more volatile or non-volatile memory devices that are configured to store instructions for execution by the processor 304. Alternatively or additionally, the memory 308 may be configured to store other data to be used in connection with providing game management functions for the gaming machines 108. The illustrative types of instructions that may be stored in memory 308 include, without limitation, game management instructions 316, audio coordination instructions 212, a mixer 224, and a filter 228. The memory 308 is also shown to include instructions for executing an RNG 320, though it should be appreciated that functionality of an RNG 320 may be provided by the processor 304 without executing instructions from memory. Rather, the RNG 320 may correspond to a particular routine that is natively built into the processor 304 and/or that relies on a clock of the processor 304 for generating a random or pseudo random output when called. Alternatively or additionally, the RNG 320 may be provided as part of game management instructions 312 and/or game instructions 208 of a gaming machine 108.

The game management instructions 316, when executed by the processor 304, may enable the game management system 116 to provide game management features and functions for some or all of the gaming machines 108. In some embodiments, the game management instructions 316 may be configured to interact with game instructions 208 of a gaming machine 108.

Shared Audio Content

Figure 4A:
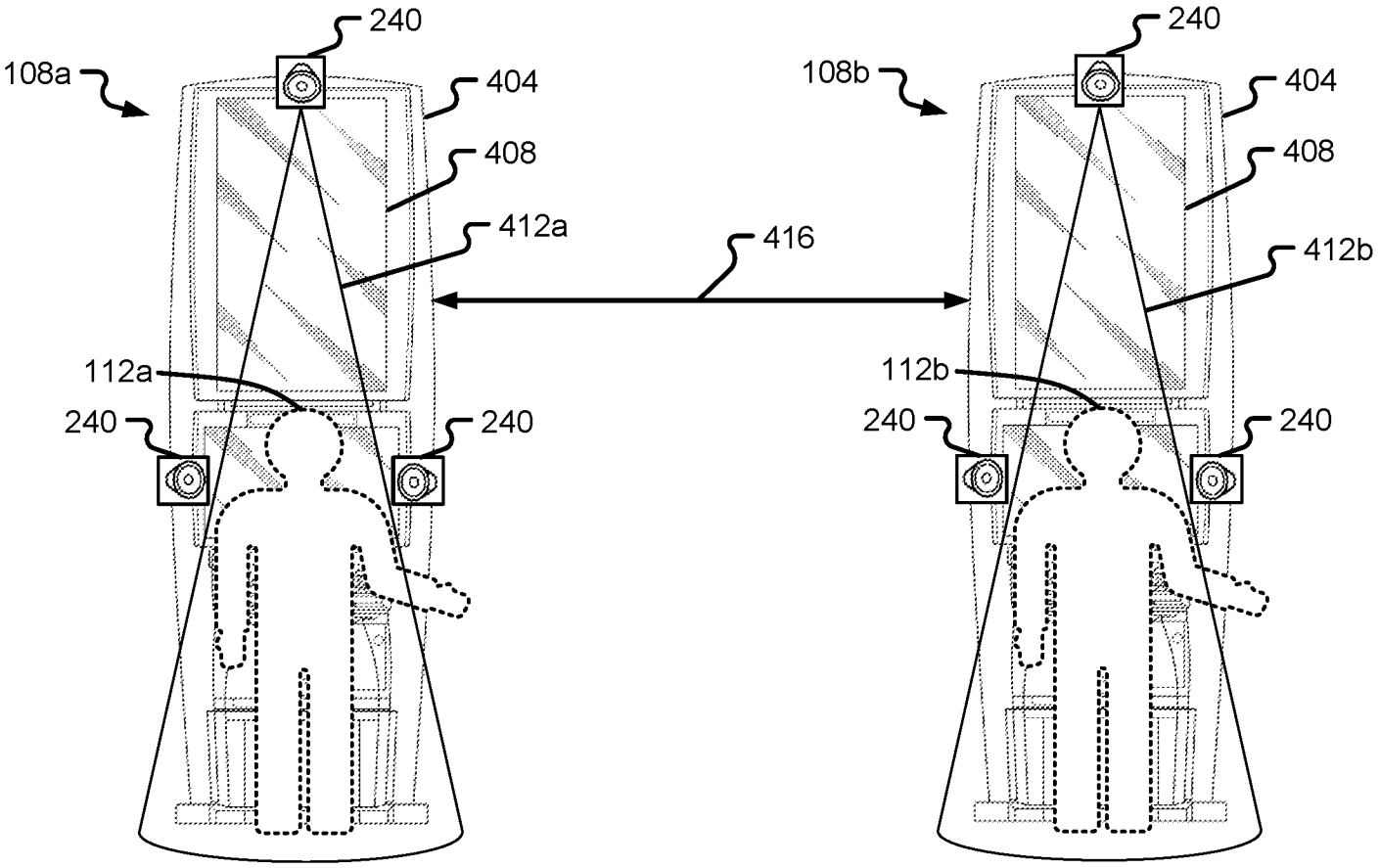
FIG. 4A is a diagram depicting two gaming machines exchanging shared audio content and playing the shared audio content via a directed sound beam in accordance with embodiments of the present disclosure.
Figure 4B:
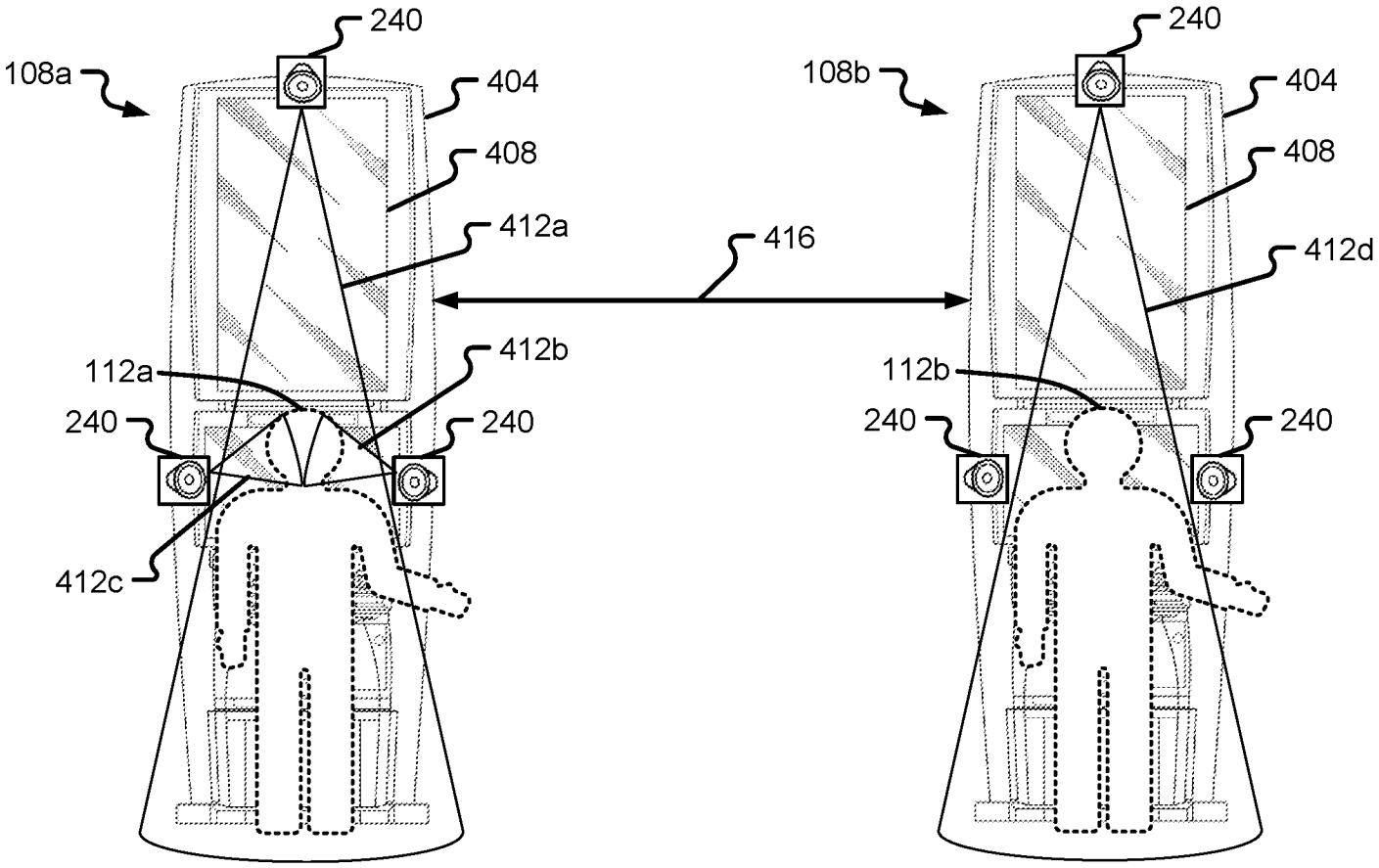
FIG. 4B is another diagram depicting two gaming machines exchanging shared audio content and playing the shared audio content via more than one directed sound beam in accordance with embodiments of the present disclosure.

With reference now to FIGS. 4A and 4B, additional details regarding the sharing of audio content between gaming machines 108 will be described in accordance with embodiments of the present disclosure. Referring initially to FIG. 4A, a first gaming machine 108*a* is shown to be in communication with a second gaming machine 108*b* via a communication link 416. The communication link 416 may correspond to a direct communication pathway or may correspond to a communication pathway that flows through the communication network 104. The communication link 416 may be configured to carry shared audio content between the first gaming machine 108*a* and second gaming machine 108*b*. Specifically, gameplay audio generated at the first gaming machine 108*a* may be transmitted as shared audio content to the second gaming machine 108 via the communication link 416. Similarly, gameplay audio generated at the second gaming machine 108*b* may be transmitted as shared audio content to the first gaming machine 108 via the communication link 416. Thus, it should be appreciated that the communication link 416 may be a unidirectional communication link or a bidirectional communication link without departing from the scope of the present disclosure.

Each gaming machine 108*a*, 108*b* is also shown to include a housing 404 and a display screen 408. The housing 404 may correspond to a physical structure that supports the components of the gaming machine 108*a*, 108*b*. The display 408 of each gaming machine 108*a*, 108*b* may be an example of a user interface device 272 and may be used to present graphical elements to the user 112*a*, 112*b* of the gaming device 108*a*, 108*b*.

Each gaming device 108*a*, 108*b* is also depicted to include a plurality of speaker arrays 240, where each speaker array 240 may include a plurality of speakers 244. In some embodiments, each speaker array 240 of a gaming machine 108 may be controlled by speaker management instructions 220 of the gaming machine 108. FIG. 4A illustrates a scenario in which a first user 112*a* and second user 112*b* of a first gaming machine 108*a* and second gaming machine 108*b*, respectively, are allowed to share audio content between their gaming machines 108*a*, 108*b*. In the embodiment of FIG. 4A, the first gaming machine 108*a* may transmit shared audio content to the second gaming machine 108*b* via the communication link 416. The second gaming machine 108*b* may then produce a second sound beam 412*b* that includes the shared audio content received from the first gaming machine 108*a*. In this way, the second user 112*b* can hear audio content from the first gaming machine 108*a* without necessarily making the shared audio content audible for other people not within the second sound beam 412*b*. Similarly, the second gaming machine 108*b* may transmit shared audio content to the first gaming machine 108*a* via the communication link 416. The first gaming machine 108*a* may then produce a first sound beam 412*a* that includes the shared audio content received from the second gaming machine 108*b*. In this way, the first user 112*a* can hear audio content from the second gaming machine 108*b* without necessarily making the shared audio content audible for other people not within the first sound beam 412*a*. It should be appreciated that the first sound beam 412*a* and/or second sound beam 412*b* may output gameplay audio from the local gaming machine and/or shared audio content received from another gaming machine.

FIG. 4B illustrates further capabilities of a gaming machine 108 to produce more than one sound beam. Specifically, the first gaming machine 108*a* is shown to produce a first sound beam 412*a*, a second sound beam 412*b*, and a third sound beam 412*c*. Each sound beam 412*a*, 412*b*, 412*c* is shown as being produced by a different speaker array 240. It should be appreciated that a speaker array 240 may be configured to produce more than one sound beam without departing from the scope of the present disclosure. In some embodiments, at least one of the sound beams 412*a*, 412*b*, 412*c* produced by the first gaming machine 108*a* may be configured to simulate sounds coming from an adjacent or nearby second gaming machine 108*b*. For instance, the second sound beam 412*b* may be configured to provide shared audio content received from the second gaming machine 108*b*, thereby creating an illusion for the first user 112*a* that the shared audio content is originating from the direction of the second gaming machine 108*b*. The other sound beams 412*a*, 412*c* may be used to provide gameplay audio originating from the first gaming machine 108*a*. Thus, it may be desirable to determine a relative position of the first gaming machine 108*a* and second gaming machine 108*b* and then determine which sound beam(s) 412*a*, 412*b*, 412*c* is/are a best candidate for providing shared audio content received from the second gaming machine 108*b* to provide the simulation or sensation that the shared audio content is origination from the direction of the second gaming machine 108*b*.

Although the second gaming machine 108*b* is not shown as producing more than one sound beam (e.g., a fourth sound beam 412*d*), it should be appreciated that the second gaming machine 108*b* may also be configured to produce multiple sound beams without departing from the scope of the present disclosure. Furthermore, although not depicted, it should be appreciated that the first user 112*a* and/or second user 112*b* may be provided with headphones or other devices that include one or more speakers 244. The second gaming machine 108*b* may also be configured to only play gameplay audio via the fourth sound beam 412*d* while simultaneously sharing its gameplay audio as shared audio content that is transmitted to the first gaming machine 108*a*.

Methods

With reference now to FIGS. 5-11, various methods will be described in accordance with at least some embodiments of the present disclosure. It should be appreciated that the disclosed methods may be performed by one, some, or all of the devices depicted and described herein. Said another way, any device within the system 100 may be used to perform some or all of a method depicted and described herein. Moreover, although certain steps are depicted as being performed in a certain order or in connection with a particular method, it should be appreciated that any method step depicted and described herein may be performed in combination with any other method step depicted and described herein.

Figure 5:
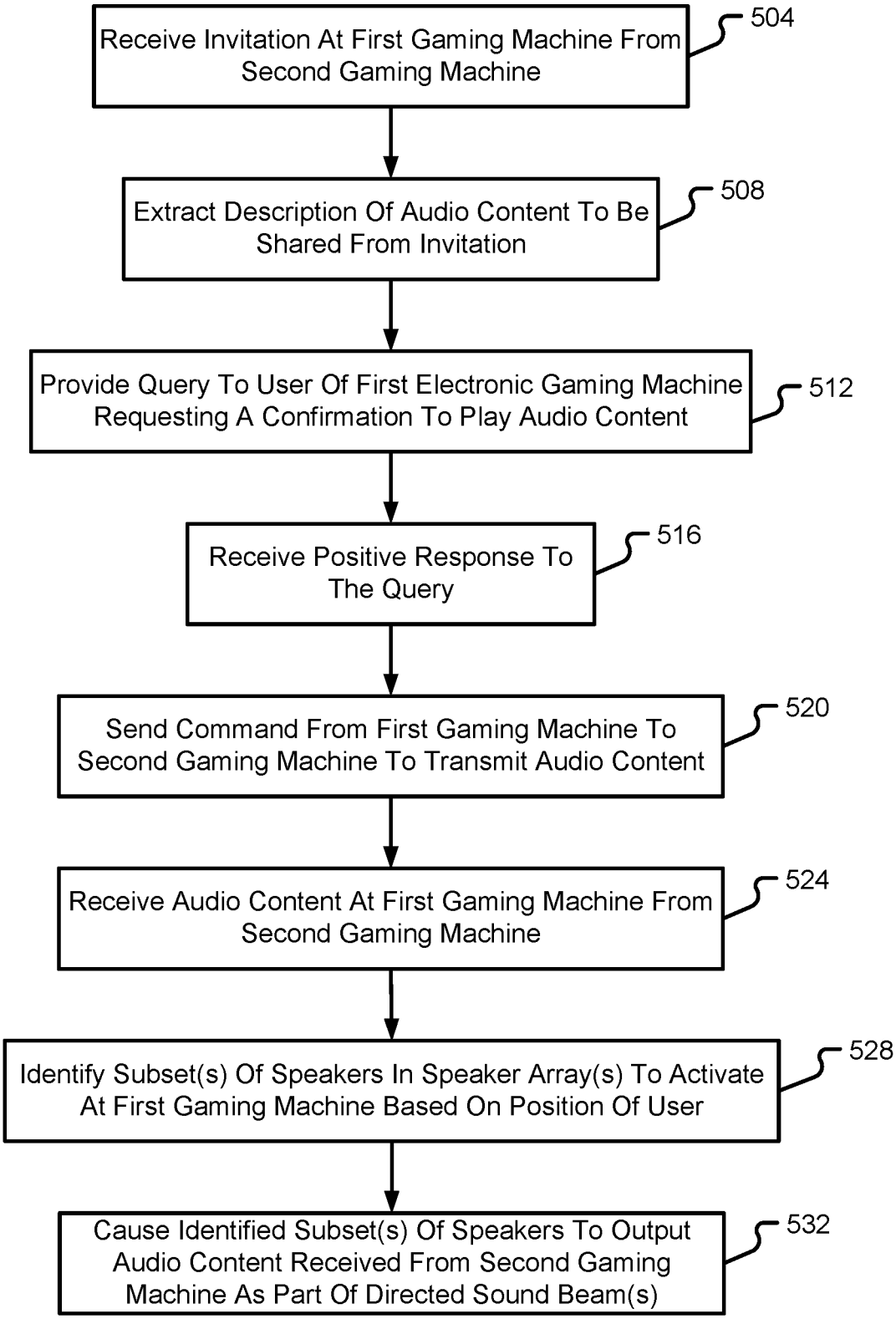
FIG. 5 is a flow diagram depicting a method of sharing audio content and playing the shared audio content via one or more directed sound beams in accordance with embodiments of the present disclosure.

Referring initially to FIG. 5, a method of sharing audio content and playing the shared audio content via one or more directed sound beams will be described in accordance with embodiments of the present disclosure. The method begins when a first gaming machine 108*a* receives an invitation from a second gaming machine 108*b* (step 504). The invitation may include a general invitation to provide shared audio content from the second gaming machine 108*b* to the first gaming machine 108*a*. The invitation may also include more specific information, such as a description of the audio content to be shared by the second gaming machine 108*b*. For example, the invitation may describe that only winning event sounds will be provided as shared audio content or that only particular types of sound effects will be provided as shared audio content. As still another example, the invitation may describe information about the second gaming machine 108*b* (e.g., an absolute location of the second gaming machine 108*b*, a location of the second gaming machine 108*b* relative to the first gaming machine 108*a*, sound compression/encoding capabilities of the second gaming machine 108*b*, how shared audio content would be encoded or transmitted to the first gaming machine 108*a*, etc.). Indeed, any unique aspect of the shared audio content may be described in the invitation.

The method may proceed with the first gaming machine 108*a* utilizing the audio coordination instructions 212 to extract the description of audio content from the invitation (step 508). The extracted description of the audio content may then be used by the audio coordination instructions 212 to generate and provide a query to the first user 112*a* (step 512). The query provided to the first user 112*a* may include a request for confirmation that the first user 112*a* desires to receive shared audio content from another gaming machine (e.g., the second gaming machine 108*b* being operated by the second player 112*b*). The query may also include information describing the position of the second gaming machine 108*b* relative to the first gaming machine 108*a*, an identification of the second gaming machine 108*b*, an identification of the second player 112*b*, a description of the audio content to be shared, etc. The query may also provide the first user 112*a* with options for defining audio sharing preferences and settings 216. In particular, the query may include a request for playback preferences of the shared audio content, which may stand alone or be defined relative to gameplay audio generated by the first gaming machine 108*a*. Examples of such relative preferences that may be defined by the first user 112*a* in this step include defining that the gameplay audio should always be played louder than the shared audio content, defining that only certain types of audio events should be played for the shared audio content, defining that the shared audio content should be played louder than the gameplay audio, defining that both the gameplay audio and shared audio content should be played at the same volume, defining that the shared audio content should be played with an effort to simulate sounds emanating from a direction of the second gaming machine 108*b*, etc.

The method may then proceed with the first user 112*a* responds positively to the query, indicating a desire to receive the shared audio content (step 516). Upon receiving the positive response to the query, the audio coordination instructions 212 may cause the first gaming machine 108*a* to transmit a command to the second gaming machine 108*b* that instructs the second gaming machine 108*b* to start sharing audio content (step 520). The command may also include information required to establish or maintain the communication link 416 between the gaming machines 108*a*, 108*b*.

Upon receiving the command, the second gaming machine 108*b* may begin processing and transmitting shared audio content to the first gaming machine 108*a*. The method may continue when the first gaming machine 108*a* receives the shared audio content at its network interface 276 (step 524). The received shared audio content may then be processed by the audio coordination instructions 212 and/or speaker management instructions 220 to identify a particular subset of speakers 244 in a speaker array 240 to use for outputting the shared audio content (step 528). In some embodiments, the selection of speakers 244 may be based on the preferences and settings 216 defined by the first user 112*a*. Alternatively or additionally, the selection of speakers 244 may be based on a position of the first user 112*a* (or first user's 112*a* head) relative to the first gaming machine 108*a*. The selection of speakers 244, in some embodiments, may be based on producing a sound beam that is audible for the first user 112*a* but not for other people near the first gaming machine 108*a*.

The selected speaker(s) 244 from one or more different speaker arrays 240 may then be used to output the audio content received from the second gaming machine 108*b* (step 532). In some embodiments, the audio content may be provided by the selected speaker(s) 244 in the form of a sound beam that specifically makes the shared audio content audible for the first user 112*a*, but not another person nearby the first user 112*a* and outside of the sound beam.

Figure 6:
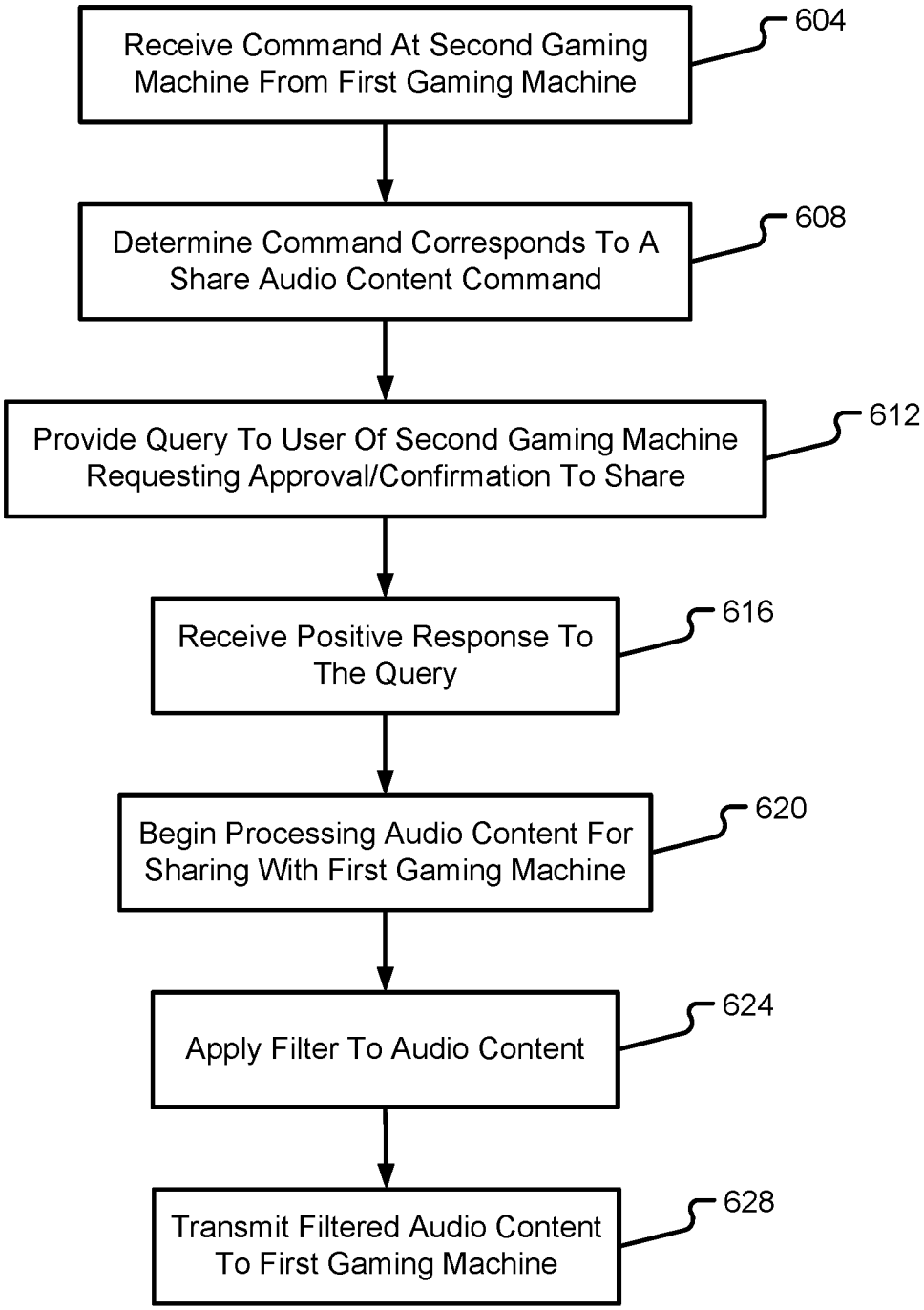
FIG. 6 is a flow diagram depicting a method of filtering audio content prior to transmitting the audio content to another gaming machine in accordance with embodiments of the present disclosure.

Referring now to FIG. 6, a method of filtering audio content prior to transmitting the audio content to another gaming machine will be described in accordance with embodiments of the present disclosure. In some embodiments, the filtering of audio content prior to transmitting the audio content to another gaming machine 108 may help reduce network bandwidth consumption during transmission of the shared audio content. Filtering of the audio content prior to transmitting the audio content may also enable the gaming machine 108 that is transmitting the shared audio content to filter the audio content in accordance with preferences of the user 112 in front of that gaming machine 108 rather than applying a filter based on preference of another user 112 in front of the gaming machine 108 that receives the shared audio content.

The illustrative method begins when a second gaming machine 108*b* receives a command from a first gaming machine 108*a* to begin sharing audio content (step 604). The command received at the second gaming machine 108*b* in this particular step may be similar to the command described with reference to step 520 of FIG. 5. This particular method, however, may correspond to a method that is initiated by the first gaming machine 108*a* (e.g., the gaming machine desiring to receiving shared audio content) rather than being initiated by the second gaming machine 108*b* (e.g., the gaming machine desiring to send shared audio content).

The method continues when the second gaming machine 108*b* invokes its audio coordination instructions 212 to determine that the command corresponds to a share audio content command (step 608). This determination may cause the audio coordination instructions 212 to provide a query to a user 112 of the second gaming machine 108*b* (e.g., the second user 112*b*) (step 612). The query, in some embodiments, may indicate a request for audio content from the second gaming machine 108*b* in the form of shared audio content. The audio content requested of the second gaming machine 108*b* may include gameplay audio associated with gameplay between the second user 112*b* and the second gaming machine 108*b*. In other words, the requested shared audio content may correspond to gameplay audio originating at the second gaming machine 108*b*.

The method may continue when a positive response to the query is received from the second user 112*b* (step 616). Thereafter, the second gaming machine 108*b* may being processing audio content for sharing with the first gaming machine 108*a* (e.g., the machine that transmitting the command received in step 604) (step 620). As part of processing, the second gaming machine 108*b* may utilize the audio coordination instructions 212 to begin filtering out sounds other than winning event sounds from the gameplay audio generated at the second gaming machine 108*b* by the game instructions 208 thereof (step 624). In some embodiments, a number of filters may be applied to the gameplay audio to convert the gameplay audio into audio content to be shared with the first gaming machine 108*a*. As an example, the second gaming machine 108*b* may apply a first filter that filters out background music from the gameplay audio then apply a second filter that filters out sound effects other than sound effects associated with winning events. Certain embodiments also contemplate the ability to filter out certain type of sounds associated with certain winning events, but not other sounds associated with other winning events. For instance, the filter applied in step 624 may filter out sounds not associated with a jackpot event or sounds not associated with a bonus game.

After the gameplay audio has been filtered and converted into audio content for sharing with the first gaming machine 108*a*, the method may continue with the second gaming machine 108*b* transmitting the audio content to the first gaming machine 108*a* as shared audio content (step 628). The shared audio content, in some embodiments, may correspond to filtered versions of gameplay audio generated at the second gaming machine 108*b*.

Figure 7:
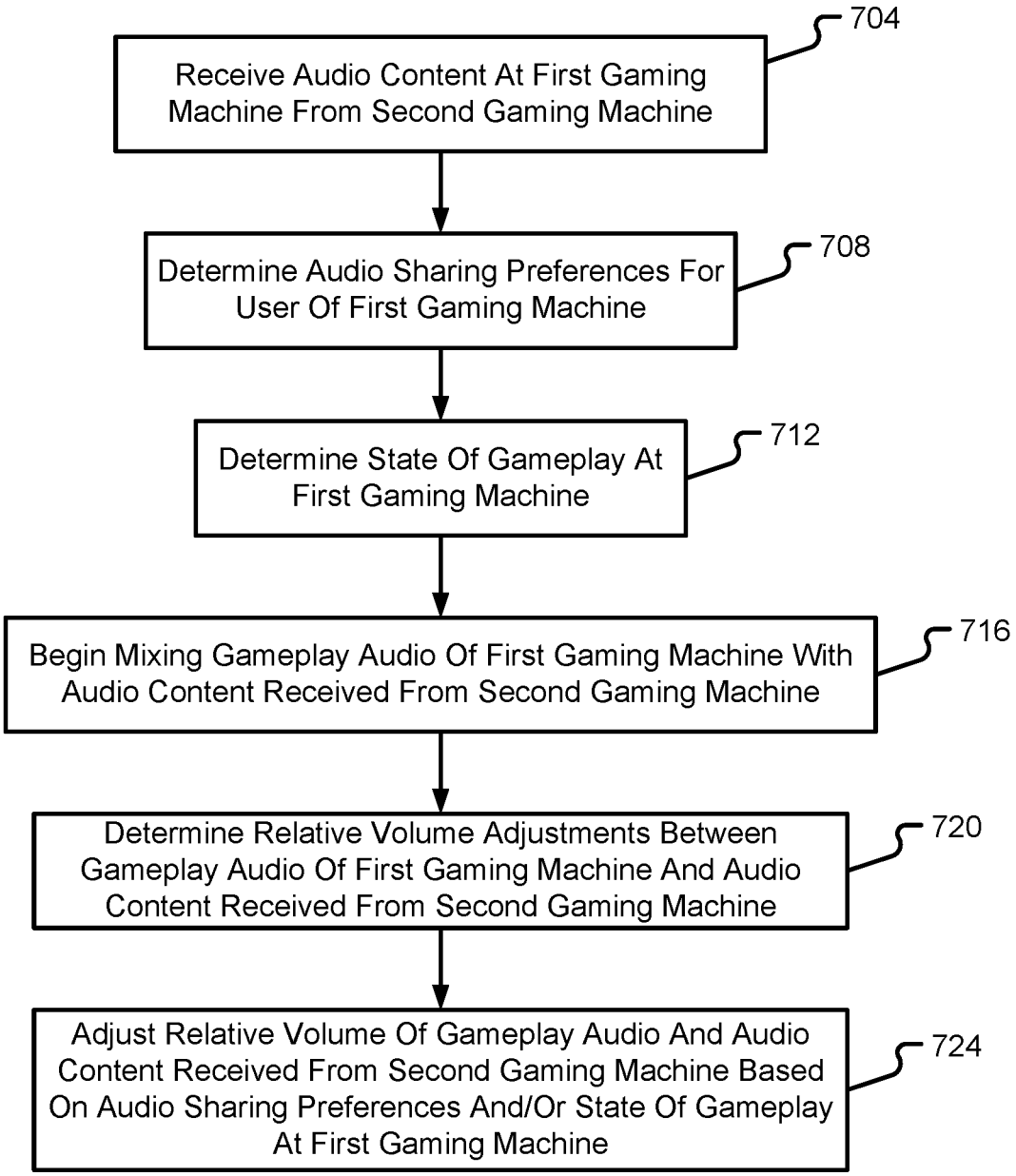
FIG. 7 is a flow diagram depicting a method of mixing gameplay audio with shared audio content at a gaming machine in accordance with embodiments of the present disclosure.

Referring now to FIG. 7, a method of mixing gameplay audio with shared audio content at a gaming machine will be described in accordance with embodiments of the present disclosure. The method begins when the first gaming machine 108*a* receives shared audio content from the second gaming machine 108*b* (step 704). The shared audio content may be received at the network interface 276 and then be provided to the audio coordination instructions 212 for processing.

The audio coordination instructions 212 may then reference preferences and settings 216 at the first gaming machine 108*a* (step 708). In some embodiments, the preferences and settings 216 may define or describe audio sharing preferences for the user 112 of the first gaming machine 108*a* (e.g., the first user 112*a*).

The audio coordination instructions 212 may also refer to the game instructions 208 to determine a state of gameplay at the first gaming machine 108*a* (step 712). In this step, the audio coordination instructions 212 may determine a state of the game being played by the first user 112*a* on the first gaming machine 108*a*. For instance, the state of the game at the first gaming machine 108*a* may correspond to an idle state where the first user 112*a* is not currently playing a game supported by a wager. As another example, the state of the game at the first gaming machine 108*a* may correspond to a bonus game state where the first user 112*a* is currently playing a bonus game. As another example, the state of the game at the first gaming machine 108*a* may correspond to a win state or a jackpot state where the first gaming machine 108*a* is providing visual and/or audible output associated with a win or jackpot.

The method continues with the audio coordination instructions 212 leveraging the speaker management instructions 220 and mixer 224 to begin mixing gameplay audio originating from the first gaming machine 108*a* with shared audio content received from the second gaming machine 108*b* (step 716). The audio coordination instructions 212 and/or speaker management instructions 220 may be configured to determine a relative volume desired for the gameplay audio and shared audio content (step 720). In some embodiments, the relative volume adjustments determined in step 720 may be based on the sharing preferences determined in step 708 and/or the state of gameplay determined in step 712.

The method then proceeds with the speaker management instructions 220 adjusting the relative volume of the gameplay audio and shared audio content based on the audio sharing preferences and/or state of gameplay as determined in step 720 (step 724). In some embodiments, the adjustment of volumes may be performed at the mixer 224 or may be performed by each individual speaker 244, depending upon speaker driving capabilities and/or capabilities of the mixer 224.

Figure 8:
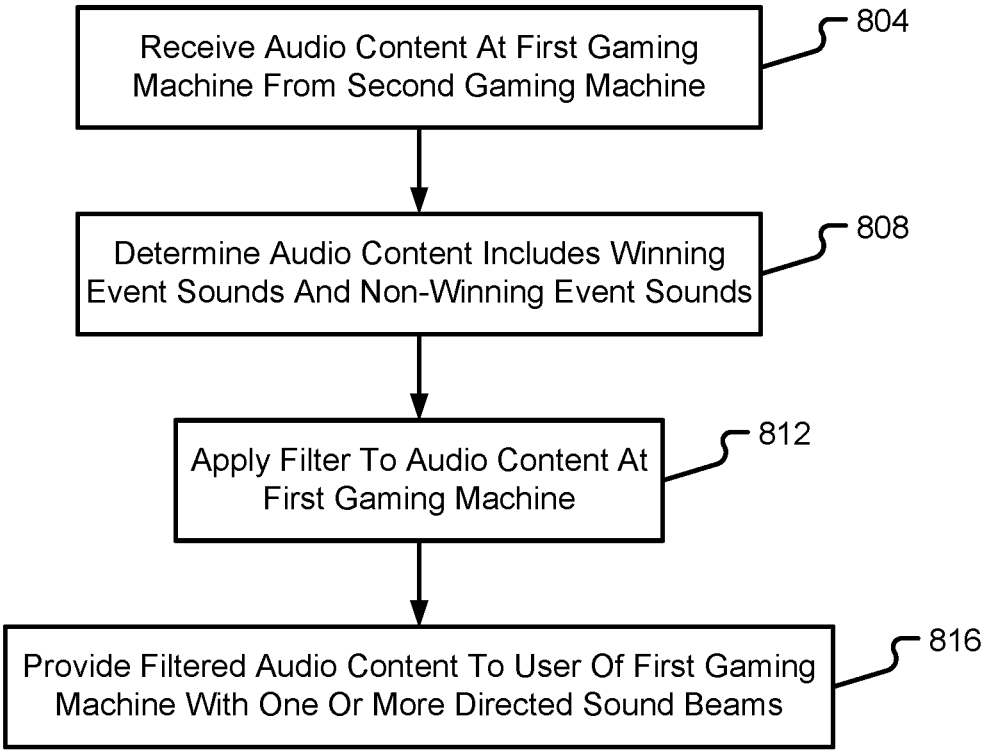
FIG. 8 is a flow diagram depicting a method of filtering audio content after receiving audio content from another gaming machine in accordance with embodiments of the present disclosure.

Referring now to FIG. 8, a method of filtering audio content after receiving audio content from another gaming machine will be described in accordance with embodiments of the present disclosure. The method begins when shared audio content is received at a first gaming machine 108*a* from a second gaming machine 108*b* (step 804). The method continues with the first gaming machine 108*a* processing the received shared audio content and determining that the shared audio content includes sounds associated with winning events and sounds associated with non-winning events (step 808). Sounds associated with non-winning events may include background sounds, background music, soundtracks, character dialog, sound effects of a spinning reel, etc. Sounds associated with winning events may include sound effects for bonus games, sound effects for winning a jackpot, music or audio associated with a bonus game, music or audio associated with a jackpot, etc.

The first gaming machine 108*a* may then utilize its filter 228 to filter audio content (step 812). In some embodiments, the first gaming machine 108*a* may filter out sounds associated with non-winning events from the shared audio content. The filtered version of the shared audio content may then be provided to the first user 112*a* with one or more directed sound beams produced by one or more speakers 244*a* of a speaker array 240 (step 816).

Figure 9:
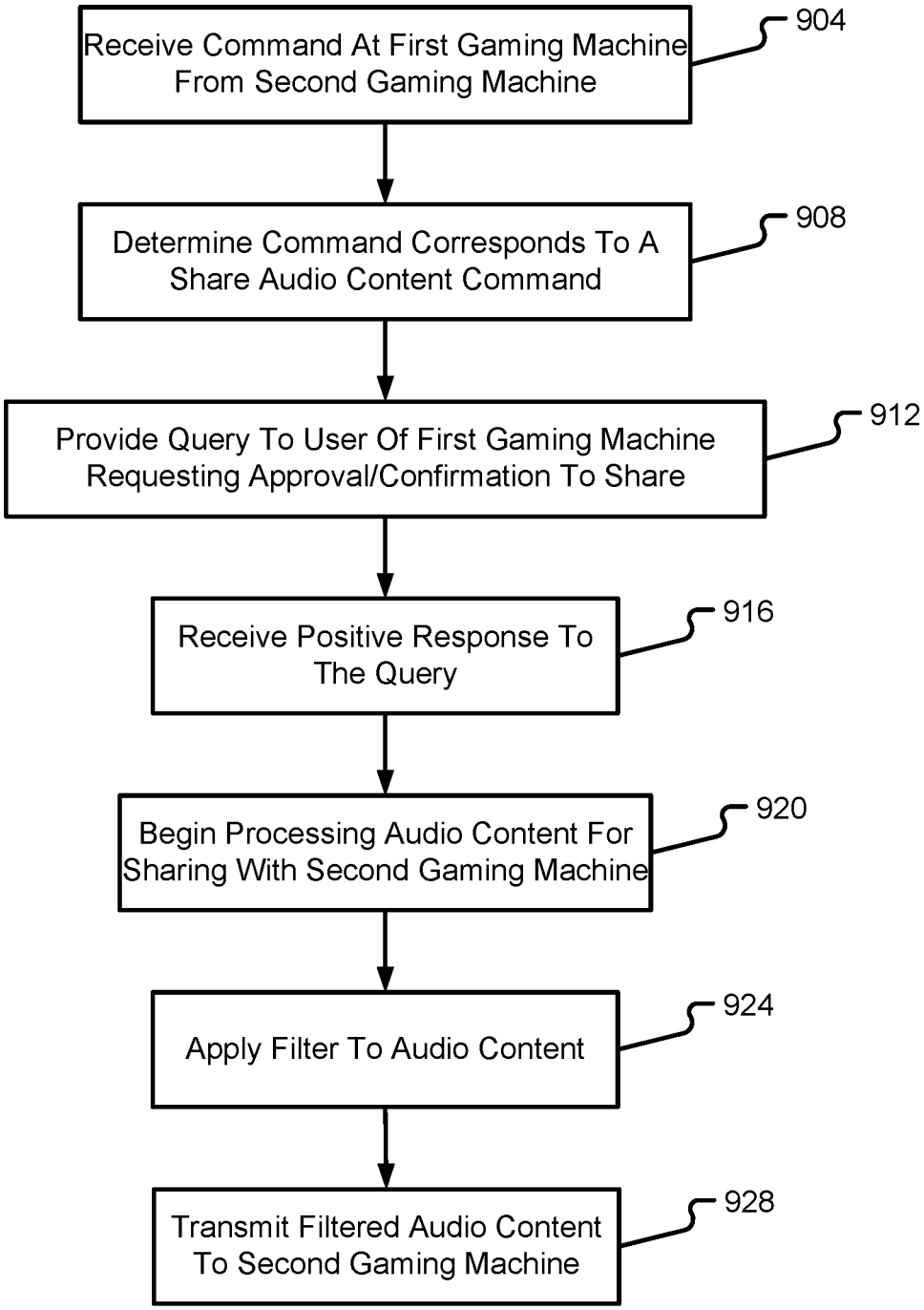
FIG. 9 is a flow diagram depicting another method of filtering audio content prior to transmitting the audio content to another gaming machine in accordance with embodiments of the present disclosure.

Referring now to FIG. 9, a method of filtering audio content prior to transmitting the audio content to another gaming machine will be described in accordance with embodiments of the present disclosure. The method begins when a first gaming machine 108*a* receives a command from a second gaming machine 108*b* (step 904). The command received may correspond to a request for the first gaming machine 108*a* to share audio content with the second gaming machine 108*b*. Thus, the method may continue when the first gaming machine 108*a* determines that the command corresponds to a share audio content command (step 908). The command received in step 904 may be received before, after, or while the first gaming machine 108*a* is receiving and playing shared audio content from the second gaming machine 108*a*. In other embodiments, the command may be received even if the first gaming machine 108*a* is not receiving shared audio content from the second gaming machine 108*b*.

The method may then continue with the first gaming machine 108*a* providing a query to a user 112 thereof (e.g., the first user 112*a*) requesting an approval or confirmation that the user 112 is willing to share audio content originating from the first gaming machine 108*a* (step 912). The method may only be allowed to continue when a positive response to the query is received from the user 112 (step 916). In some embodiments, the query may be provided to the user 112 via the display 408 or any other type of user interface device 272 of the first gaming machine 108*a*.

After a positive response to the query is received, the method may then continue with the first gaming machine processing audio content for sharing with the second gaming machine 108*b* (step 920). In some embodiments, gameplay audio originating from the first gaming machine 108*a* may be passed through the filter 228 to remove any type of unwanted sounds, music, and/or sound effects (step 924). After the first gaming machine 108*a* has processed and filtered the gameplay audio, the filtered audio content may be transmitted to the second gaming machine 108*b* via the network interface 276 of the first gaming machine 108*a* (step 928). More specifically, the first gaming machine 108*a* may transmit shared audio content to the second gaming machine 108*b* via the communication link 416 established between the first gaming machine 108*a* and second gaming machine 108*b*.

Figure 10:
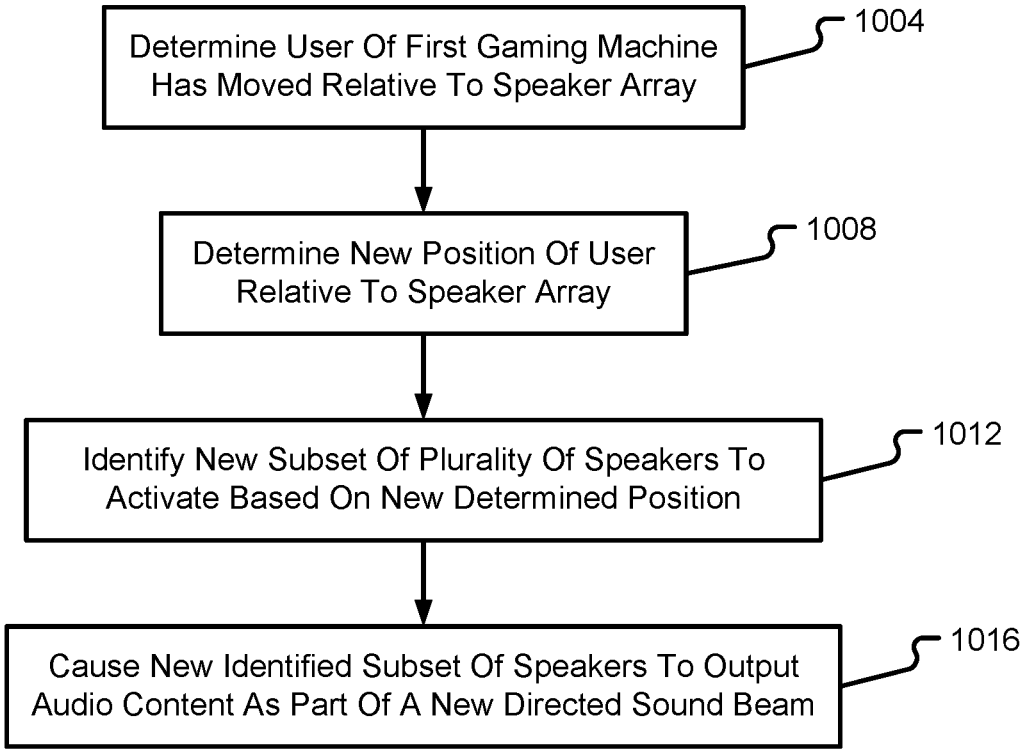
FIG. 10 is a flow diagram depicting a method of outputting shared audio content with a directed sound beam based on a relative position of gaming machines in accordance with embodiments of the present disclosure.

Referring now to FIG. 10, a method of outputting shared audio content with a directed sound beam based on a relative position of gaming machines will be described in accordance with embodiments of the present disclosure. While embodiments will be described in connection with operations of the first gaming machine 108*a*, it should be appreciated that the second gaming machine 108*b* or any other gaming machine 108 depicted and described herein may be configured to perform the steps of the method shown in FIG. 10. The method begins with speaker management instructions 220 of the first gaming machine determining that a user of the first gaming machine 108*a* (e.g., the first user 112*a*)

has moved relative to a speaker array 240 or multiple speaker arrays 240 of the first gaming machine 108*a* (step 1004). In some embodiments, the speaker management instructions 220 may determine that the first user 112*a* has moved relative to the housing 404 or some other component of the first gaming machine 108*a*.

In response to determining that the first user 112*a* has moved, the method may continue with the speaker management instructions 220 determining a new position of the first user 112*a* relative to the speaker array 240 (or other point of reference of the first gaming machine 108*a*) (step 1008). Based on the new determined position of the first user 112*a*, the speaker management instructions 220 may identify a new subset of the plurality of speakers 244 to activate and provide a sound beam to the first user 112*a* (step 1012). It may be possible that the new subset is exactly the same as the subset of speakers 244 that were previously providing the sound beam prior to detecting user movement. It may also be possible that the new subset is different from the subset of speakers 244 that were previously providing the sound beam prior to detecting user movement.

The new subset of speakers 244 may then be activated to output shared audio content and/or gameplay audio for the first user 112*a* (step 1016). In some embodiments, the shared audio content and/or gameplay audio output in step 1016 may be provided via a new directed sound beam that is different from a sound beam that was previously providing shared audio content and/or gameplay audio to the first user 112*a* prior to detecting user movement. It should also be appreciated that multiple different sound beams may be used to provide the shared audio content and/or gameplay audio after detecting user movement.

Figure 11:
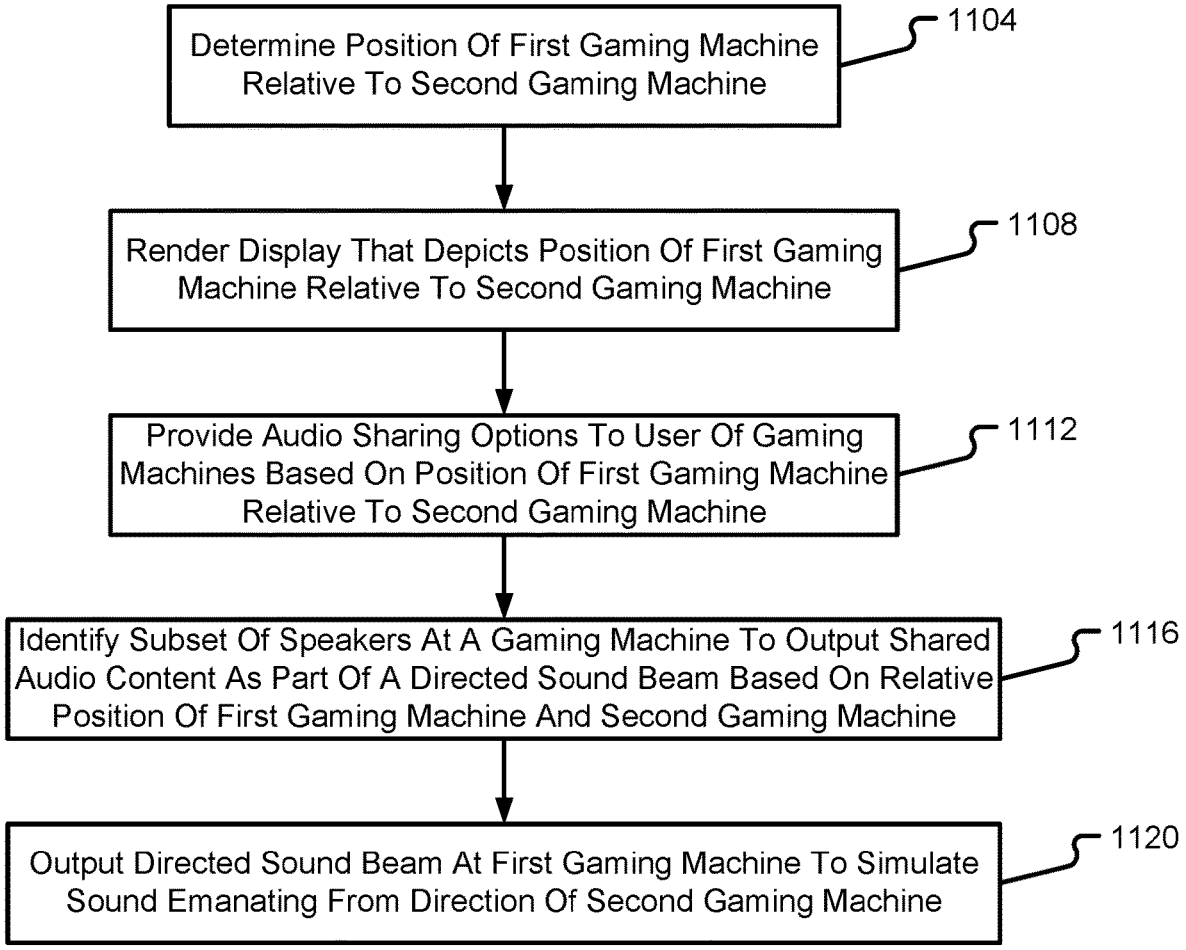
FIG. 11 is a flow diagram depicting a method of simulating sound emanating from another gaming machine with a directed sound beam in accordance with embodiments of the present disclosure.

Referring now to FIG. 11, a method of simulating sound emanating from another gaming machine with a directed sound beam will be described in accordance with embodiments of the present disclosure. The method begins by determining a position of a first gaming machine 108*a* relative to a second gaming machine 108*b*, or vice versa (step 1104). The relative position of gaming machines 108*a*, 108*b* may be determined by the audio coordination instructions 212 and may be determined by analyzing location information shared between the gaming machines 108*a*, 108*b* during negotiation/establishment of audio content sharing preferences and/or establishment of the communication link 416.

The method may continue with the audio coordination instructions 212 causing the display screen 408 of the first gaming machine 108*a* to depict a position of the first gaming machine 108*a* relative to the second gaming machine 108*a*, or vice versa (step 1108). The method may also include providing audio sharing options to the user of one or both gaming machines 108*a*, 108*b* (step 1112). The options provided to the user(s) may include options for sharing audio content and/or options for causing shared audio content to sound as if it were emanating from a direction of the other gaming machine 108 from which the shared audio content was received. In other words, the user(s) 112 may be provided with an option to simulate audio emanating from a particular direction of the gaming machine 108 that ultimately plays the shared audio content.

The method may then continue with the audio coordination instructions 212 and/or speaker management instructions 220 identifying a subset of the speakers 244 in a speaker array 240 that can be used to output shared audio content as part of a directed sound beam based on the relative position of the first gaming machine 108*a* and second gaming machine 108*b* (step 1116). The speaker management instructions 220 may then cause the subset of speakers 244 identified in step 1116 to output a directed sound beam such that the sound output by the directed sound beam simulates sound emanating from a direction of the second gaming machine 108*b* (step 1120). As an example, if the second gaming machine 108*b* is positioned to the right of the first gaming machine 108*a*, then the directed sound beam output in step 1120 may be output by speakers 244 positioned on a right side of the first gaming machine 108*a* so as to produce a directed sound beam that appears to the first user 112*a* as though the sound is originating from a direction of the second gaming machine 108*b* (e.g., from a direction to the right of the first gaming machine 108*a*).

Variants

The present disclosure contemplates a variety of different gaming systems and environments each having one or more of a plurality of different features, attributes, or characteristics. A "gaming system" or "gaming environment" as used herein refers to various configurations of: (a) one or more central servers, central controllers, or remote hosts; (b) one or more electronic gaming machines such as those located on a casino floor; and/or (c) one or more gaming devices, such as desktop computers, laptop computers, tablet computers or computing devices, personal digital assistants, mobile phones, and other mobile computing devices. Moreover, an EGM as used herein refers to any suitable electronic gaming machine which enables a player to play a game (including but not limited to a game of chance, a game of skill, and/or a game of partial skill) to potentially win one or more awards, wherein the EGM comprises, but is not limited to: a slot machine, a video poker machine, a video lottery terminal, a terminal associated with an electronic table game, a video keno machine, a video bingo machine located on a casino floor, a sports betting terminal, or a kiosk, such as a sports betting kiosk.

In various embodiments, the gaming system of the present disclosure includes: (a) one or more electronic gaming machines in combination with one or more central servers, central controllers, or remote hosts; (b) one or more gaming devices in combination with one or more central servers, central controllers, or remote hosts; (c) one or more gaming devices in combination with one or more electronic gaming machines; (d) one or more gaming devices, one or more electronic gaming machines, and one or more central servers, central controllers, or remote hosts in combination with one another; (e) a single electronic gaming machine; (f) a plurality of electronic gaming machines in combination with one another; (g) a single gaming device; (h) a plurality of gaming devices in combination with one another; (i) a single central server, central controller, or remote host; and/or (j) a plurality of central servers, central controllers, or remote hosts in combination with one another.

For brevity and clarity and unless specifically stated otherwise, "EGM" as used herein represents one EGM or a plurality of EGMs, "gaming device" as used herein represents one gaming device or a plurality of gaming devices and, in some embodiments, may include an EGM or multiple EGMs. The use of "server, central server, central controller, or remote host" as used herein represents one central server, central controller, or remote host or a plurality of central servers, central controllers, or remote hosts.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system includes a plurality of EGMs that are each configured to communicate with a central server, central controller, or remote host through a data network.

In certain embodiments in which the gaming system includes an EGM in combination with a central server, central controller, or remote host, the central server, central controller, or remote host is any suitable computing device (such as a server) that includes at least one processor and at least one memory device or data storage device. As further described herein, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. One, more than one, or each of the functions of the central server, central controller, or remote host may be performed by the at least one processor of the EGM. Further, one, more than one, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a communication network, the communication network may include a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a communication network, the communication network may include a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. In certain embodiments in which the communication network includes a WAN, the gaming system includes a central server, central controller, or remote host and an EGM each located in a different gaming establishment in a same geographic area, such as a same city or a same state. Gaming systems in which the communication network includes a WAN are substantially identical to gaming systems in which the communication network includes a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a communication network, the communication network may include an internet (such as the Internet) or an intranet. In certain such embodiments, an Internet browser of the EGM is usable to access an Internet game page from any location where an Internet connection is available. In one such embodiment, after the EGM accesses the Internet game page, the central server, central controller, or remote host identifies a player before enabling that player to place any wagers on any plays of any wagering games. In one example, the central server, central controller, or remote host identifies the player by requiring a player account of the player to be logged into via an input of a unique player name and password combination assigned to the player. The central server, central controller, or remote host may, however, identify the player in any other suitable manner, such as by validating a player tracking identification number associated with the player; by reading a player tracking card or other smart card inserted into a card reader; by validating a unique player identification number associated with the player by the central server, central controller, or remote host; or by identifying the EGM, such as by identifying the MAC address or the IP address of the Internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the Internet browser of the EGM. Examples of implementations of Internet-based gaming are further described in U.S. Pat. No. 8,764,566, entitled "Internet Remote Game Server," and U.S. Pat. No. 8,147,334, entitled "Universal Game Server."

The central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile Internet network), or any other suitable medium. The expansion in the quantity of computing devices and the quantity and speed of Internet connections in recent years increases opportunities for players to use a variety of EGMs to play games from an ever-increasing quantity of remote sites. Additionally, the enhanced bandwidth of digital wireless communications may render such technology suitable for some or all communications, particularly if such communications are encrypted. Higher data transmission speeds may be useful for enhancing the sophistication and response of the display and interaction with players.

As should be appreciated by one skilled in the art, aspects of the present disclosure have been illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "circuit," "module," "component," or "system." Furthermore, aspects of the present disclosure may take the form of a computer program product embodied in one or more computer readable media having computer readable program code embodied thereon.

Any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure have been described herein with reference to flowchart illustrations and/or block diagrams of methods, apparatuses (systems) and computer program products according to embodiments of the disclosure. It should be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

The term "a" or "an" entity refers to one or more of that entity. As such, the terms "a" (or "an"), "one or more," and "at least one" can be used interchangeably herein. It is also to be noted that the terms "comprising," "including," and "having" can be used interchangeably.

What is claimed is:

1. An electronic gaming machine, comprising:

a housing;

a network interface;

a speaker array connected with the housing and comprising a plurality of speakers positioned to output directed sound beams at different angles relative to a front side of the housing;

a processor coupled with the speaker array and coupled with the network interface; and a memory device coupled with the processor and comprising instructions that, when executed, cause the processor to:

receive an invitation from a different electronic gaming machine that provides a description of audio content to be shared;

provide a query to a user of the electronic gaming machine requesting a confirmation to play the audio content to be shared;

receive, from the user, a positive response to the query;

send, via the network interface, a command to the different electronic gaming machine to transmit the audio content to be shared;

receive the audio content to be shared from the different electronic gaming machine;

identify a subset of the plurality of speakers to activate based on a determined position of the user relative to the speaker array;

cause the identified subset of the plurality of speakers to output the audio content to be shared as part of a directed sound beam;

determine a position of the electronic gaming machine relative to the different electronic gaming machine; and render a display showing the determined position of the electronic gaming machine relative to the different electronic gaming machine.

2. The electronic gaming machine of claim 1, wherein the instructions further cause the processor to:

receive gameplay audio associated with gameplay between the user and the electronic gaming machine;

mix the gameplay audio with the audio content to be shared; and cause the mixed gameplay audio and audio content to be shared to be output as part of the directed sound beam.

3. The electronic gaming machine of claim 2, wherein the instructions further cause the processor to:

adjust a relative volume of the gameplay audio and the audio content to be shared based on events occurring during the gameplay between the user and the electronic gaming machine.

4. The electronic gaming machine of claim 2, wherein the instructions further cause the processor to:

receive audio sharing preferences from the user; and adjust a relative volume of the gameplay audio and the audio content to be shared based on the audio sharing preferences received from the user.

5. The electronic gaming machine of claim 1, wherein the audio content to be shared comprises an audio stream received from the different electronic gaming machine, wherein the instructions further cause the processor to:

apply a filter to the audio stream that filters out sounds other than winning event sounds from the audio content to be shared.

6. The electronic gaming machine of claim 1, wherein the instructions further cause the processor to:

receive, via the network interface, a second command from the different electronic gaming machine indicating a desire to receive gameplay audio associated with gameplay between the user and the electronic gaming machine;

provide a second query to the user of the electronic gaming machine requesting a confirmation to share the gameplay audio with the different electronic gaming machine;

receive, from the user, a positive response to the second query; and transmit, via the network interface, the gameplay audio to the different electronic gaming machine.

7. The electronic gaming machine of claim 6, wherein the instructions further cause the processor to:

filter out sounds other than winning event sounds from the gameplay audio prior to transmitting the gameplay audio to the different electronic gaming machine.

8. The electronic gaming machine of claim 1, wherein the instructions further cause the processor to:

receive gameplay audio associated with gameplay between the user and the electronic gaming machine;

identify a second subset of the plurality of speakers to activate for the gameplay audio, wherein the second subset of the plurality of speakers is different from the identified subset of the plurality of speakers; and cause the identified second subset of the plurality of speakers to output the gameplay audio as part of a second directed sound beam.

9. The electronic gaming machine of claim 1, wherein the instructions further cause the processor to:

determine that the user has moved relative to the speaker array;

in response to determining that the user has moved relative to the speaker array, identify a new subset of the plurality of speakers to activate based on a new determined position of the user relative to the speaker array; and cause the new identified subset of the plurality of speakers to output the audio content to be shared as part of a new directed sound beam.

10. The electronic gaming machine of claim 1, wherein the different electronic gaming machine comprises a sports betting terminal.

11. An electronic gaming machine, comprising:

a network interface;

a processor coupled with the network interface; and a memory device coupled with the processor and comprising instructions that, when executed, cause the processor to:

receive a command from a different electronic gaming machine indicating a desire to receive gameplay audio associated with gameplay between a user and the electronic gaming machine;

provide a query to the user of the electronic gaming machine requesting a confirmation to share the gameplay audio with the different electronic gaming machine;

receive, from the user, a positive response to the query;

filter out sounds other than winning event sounds from the gameplay audio;

transmit, via the network interface, the filtered gameplay audio to the different electronic gaming machine;

determine a position of the electronic gaming machine relative to the different electronic gaming machine; and render a display showing the determined position of the electronic gaming machine relative to the different electronic gaming machine.

12. The electronic gaming machine of claim 11, further comprising:

a housing; and a speaker array connected with the housing and comprising a plurality of speakers positioned to output directed sound beams at different angles relative to a front side of the housing, wherein the instructions further cause the processor to:

receive an invitation from the different electronic gaming machine that provides a description of audio content to be shared;

provide a second query to the user requesting a confirmation to play the audio content to be shared;

receive, from the user, a positive response to the second query;

send, via the network interface, a second command to the different electronic gaming machine to transmit the audio content to be shared;

receive the audio content to be shared from the different electronic gaming machine;

identify a subset of the plurality of speakers to activate based on a determined position of the user relative to the speaker array and based on a determined position of the electronic gaming machine relative to the different electronic gaming machine; and cause the identified subset of the plurality of speakers to output the audio content to be shared as part of a directed sound beam.

13. The electronic gaming machine of claim 12, wherein the instructions further cause the processor to:

mix the gameplay audio with the audio content to be shared; and cause the mixed gameplay audio and audio content to be shared to be output as part of the directed sound beam.

14. The electronic gaming machine of claim 13, wherein the instructions further cause the processor to:

adjust a relative volume of the gameplay audio and the audio content to be shared based on events occurring during the gameplay between the user and the electronic gaming machine.

15. The electronic gaming machine of claim 12, wherein the instructions further cause the processor to:

identify a second subset of the plurality of speakers to activate for the gameplay audio, wherein the second subset of the plurality of speakers is different from the identified subset of the plurality of speakers; and cause the identified second subset of the plurality of speakers to output the gameplay audio as part of a second directed sound beam.

16. A method of operating an electronic gaming machine, the method comprising:

receiving, at a processor, an invitation from a different electronic gaming machine that provides a description of audio content to be shared;

providing, with the processor, a query to a user of the electronic gaming machine requesting a confirmation to play the audio content to be shared;

receiving, at the processor and from the user, a positive response to the query;

sending, with the processor, a command to the different electronic gaming machine to transmit the audio content to be shared;

receiving, at the processor, the audio content to be shared from the different electronic gaming machine;

identifying, with the processor, a subset of a plurality of speakers from a speaker array to activate based, at least in part, on a determined position of the user relative to the speaker array and a position of the different electronic gaming machine relative to the electronic gaming machine; and causing, with the processor, the identified subset of the plurality of speakers to output the audio content to be shared as part of a directed sound beam.

17. The method of claim 16, wherein at least one of the electronic gaming machine and the different electronic gaming machine comprises a sports betting terminal.

18. The method of claim 17, wherein the directed sound beam is directed to simulate for the user sound emanating from a direction of the different electronic gaming machine.

19. The method of claim 16, further comprising:

receiving, at the processor, gameplay audio associated with gameplay between the user and the electronic gaming machine;

mixing, with the processor, the gameplay audio with the audio content to be shared; and causing the mixed gameplay audio and audio content to be shared to be output as part of the directed sound beam.

20. The method of claim 19, further comprising:

receiving, at the processor, audio sharing preferences from the user; and adjusting, with the processor, a relative volume of the gameplay audio and the audio content to be shared based on the audio sharing preferences received from the user.

* * * * *